US007014286B2

(12) United States Patent
Yonekubo

(10) Patent No.: US 7,014,286 B2
(45) Date of Patent: Mar. 21, 2006

(54) LIQUID JETTING APPARATUS

(75) Inventor: Shuji Yonekubo, Nagano-Ken (JP)

(73) Assignee: Seiko Epson Corporation, Tokyo (JP)

( * ) Notice: Subject to any disclaimer, the term of this patent is extended or adjusted under 35 U.S.C. 154(b) by 14 days.

(21) Appl. No.: 10/073,347

(22) Filed: Feb. 13, 2002

(65) Prior Publication Data

US 2002/0118244 A1 Aug. 29, 2002

Related U.S. Application Data

(63) Continuation-in-part of application No. 09/828,998, filed on Apr. 10, 2001, now abandoned.

(30) Foreign Application Priority Data

Apr. 11, 2000 (JP) ..... 2000-109170
Feb. 13, 2001 (JP) ..... 2001-035761
Mar. 26, 2001 (JP) ..... 2001-87957

(51) Int. Cl.
*B41J 2/195* (2006.01)

(52) U.S. Cl. ..... 347/7; 347/14; 347/19

(58) Field of Classification Search ..... 347/7, 347/14, 19, 23, 9, 86, 27, 6, 30, 43
See application file for complete search history.

(56) References Cited

U.S. PATENT DOCUMENTS 4,245,224 A * 1/1981 Isayama et al. ..... 347/10
5,625,384 A 4/1997 Numata et al.
5,650,802 A * 7/1997 Suzuki et al. ..... 347/9
5,956,056 A * 9/1999 Kaneko et al. ..... 347/43
5,988,782 A * 11/1999 Miura et al. ..... 347/6
6,126,266 A * 10/2000 Numata et al. ..... 347/23
6,151,039 A 11/2000 Hmelar et al. ..... 347/7

FOREIGN PATENT DOCUMENTS

| | | |
|---|---|---|
| EP | 0 440 261 | 8/1991 |
| EP | 0 882 595 | 12/1998 |
| EP | 0 940 254 | 9/1999 |
| EP | 0 941 856 | 9/1999 |
| EP | 1 031 426 A1 | 8/2000 |
| JP | 4-250066 | 9/1992 |
| JP | 10-95132 | 4/1998 |
| JP | H10-337878 A | 12/1998 |
| JP | 2000-094715 | 4/2000 |
| WO | WO 00/15441 | 3/2000 |

* cited by examiner

*Primary Examiner*—Hai Pham
*Assistant Examiner*—Lam Nguyen
(74) *Attorney, Agent, or Firm*—Sughrue Mion, PLLC

(57) ABSTRACT

A liquid jetting apparatus of the invention uses a liquid container having a liquid chamber that contains liquid and a storing part that stores information about a time when the liquid container was manufactured. The liquid jetting apparatus includes a container-setting portion at which the liquid container is set, a head member having a nozzle, a liquid way that can communicate with the liquid chamber of the liquid container set at the container-setting portion and the nozzle, and a information reader that can read out the information stored in the storing part of the liquid container set at the container-setting portion. A liquid discharging unit that can cause the liquid to be discharged from the nozzle is controlled based on the information about the time when the liquid container was manufactured read out by the information reader.

8 Claims, 10 Drawing Sheets

LIQUID JETTING APPARATUS

This is a Continuation-In-Part of U.S. application Ser. No. 09/828,998 filed on Apr. 10, 2001, now abandoned.

FIELD OF THE INVENTION

This invention relates to a liquid jetting apparatus having a head member capable of jetting liquid from nozzles, such as an ink-jet recording apparatus having a recording head capable of jetting ink from nozzles to form dots on a recording medium. In particular, this invention relates to a liquid jetting apparatus wherein a liquid container for supplying liquid to nozzles is replaceable.

BACKGROUND OF THE INVENTION

In general, an ink-jet recording apparatus (an example of liquid jetting apparatus) comprises: a recording head (head member) having nozzles, jetting-driving means (for example, piezoelectric vibrating members or heating elements) for jetting ink (liquid) from the nozzles, and jetting controller for controlling the jetting-driving means based on recording data. Supply of the ink to the nozzles is conducted by an ink cartridge (ink container) and ink ways that extend from the ink cartridge to the nozzles. The ink cartridge is usually replaceable.

Basically, recording quality by the ink-jet recording apparatus depends on resolution of the recording head that is defined by a size (diameter) of each of the nozzles and the number of nozzles. In addition, the recording quality may be affected by the kind of ink, viscosity of the ink, blur of the ink on a recording medium, and so on.

For example, since the ink in the nozzles of the recording head is exposed to air, solvent of the ink such as water may gradually evaporate. This may increase a viscosity of the ink in the nozzles, so that quality of recorded images may deteriorate. Thus, in the ink-jet recording apparatus, in order to prevent the viscosity of the ink in the nozzles from increasing, some volume of the ink is absorbed from the nozzles (cleaning operation) or some volume of the ink is jetted from the nozzles not to form any dot on the recording medium (flushing operation).

Especially, when the ink cartridge is replaced with another new ink cartridge, the cleaning operation or the flushing operation is conducted until supply of the ink from the new ink cartridge to the nozzles becomes stable.

In addition, if the ink in the ink cartridge is running short, it may become difficult for the ink to be smoothly jetted so that recording quality may deteriorate. Thus, a timing when a volume of the ink remaining in the ink cartridge becomes less than a predetermined volume is judged as a ink end, so that an indication for requesting replacement of the ink cartridge is conducted.

However, pigment ink is used as ink having a great light-resistance. The pigment ink may consist of pigment, dispersants, solvent and additives. Especially, it is preferable that the pigment ink has a great resistance to ultraviolet-ray.

In general, the ink cartridge contains the pigment ink by containing a foam material filled (impregnated) with the pigment ink. In the ink cartridge, if a long time has passed since the ink cartridge was manufactured, dispersion of the pigment may deteriorate and the pigment may sink because of gravity. In the case, density of the ink at a base portion (at a ink supplying port side) of the ink cartridge become higher, and density of the ink at an upper portion of the ink cartridge become lower.

In order to improve such unevenness of the density of the ink, it is effective to stir the ink contained in the ink cartridge. However, it is difficult to provide any stirring mechanism for the ink cartridge containing the foam material.

SUMMARY OF THE INVENTION

The object of this invention is to solve the above problems, that is, to provide a liquid jetting apparatus such as a ink-jet recording apparatus that can suitably discharge ink from nozzles or suitably determine (judge) an ink end of an ink cartridge, based on information about a time when the ink cartridge was manufactured or any other information.

In order to achieve the object, the invention is a liquid jetting apparatus comprising: a container-setting portion at which a liquid container is set, the liquid container having a liquid chamber that contains liquid and a storing part that stores information about a time when the liquid container was manufactured; a head member having a nozzle; a liquid way that can communicate with the liquid chamber of the liquid container set at the container-setting portion and the nozzle; a information reader that can read out the information stored in the storing part of the liquid container set at the container-setting portion; a liquid discharging unit that can cause the liquid to be discharged from the nozzle; and a liquid discharging controller that can control the liquid discharging unit based on the information about the time when the liquid container was manufactured read out by the information reader.

According to the above feature, since the liquid discharging unit is controlled based on the information about the time when the liquid container was manufactured, a suitable liquid discharging operation can be conducted, for example when the liquid container is newly set.

Preferably, the liquid jetting apparatus further comprises a clock component that knows a present time, and the liquid discharging controller has: a calculating part that can calculate a passed time until the present time based on the information about the time when the liquid container was manufactured; and a main controlling part that can control the liquid discharging unit based on the passed time.

In the case, preferably, the main controlling part is adapted to control the liquid discharging unit when the liquid container is replaced with a new liquid container in such a manner that a volume of the liquid to be initially discharged is larger when the passed time calculated based on the information stored in the storing part of the new liquid container set at the container-setting portion is longer. Thus, if density of the liquid initially supplied to the nozzle is higher than a predetermined level because the passed time is longer, by the liquid discharging operation, it is possible to discharge the liquid that is initially supplied to the nozzle and that has such a higher density.

In addition, this invention is a liquid jetting apparatus comprising: a container-setting portion at which a liquid container is set, the liquid container having a liquid chamber that contains liquid and a storing part that stores information about a time when the liquid container was manufactured; a head member having a nozzle; a liquid way that can communicate with the liquid chamber of the liquid container set at the container-setting portion and the nozzle; a information reader that can read out the information stored in the storing part of the liquid container set at the container-setting portion; a liquid-consumption totaling unit that can total a liquid consumption from the nozzle; and a liquid-end determining unit that can determine a liquid end based on the information about the time when the liquid container was manufactured read out by the information reader and the liquid consumption.

According to the above feature, since the liquid end is determined (judged) based on the information about the time when the liquid container was manufactured and the liquid consumption, the liquid end can suitably correspond to density of the liquid at a predetermined level.

Preferably, the liquid jetting apparatus further comprises a clock component that knows a present time, and the liquid-end determining unit has: a calculating part that can calculate a passed time until the present time based on the information about the time when the liquid container was manufactured; and a main determining part that can determine the liquid end based on the passed time.

In the case, preferably, the main determining part is adapted to determine the liquid end correspondingly to a smaller liquid consumption when the passed time is longer. Thus, if density of the running-short but still remaining liquid is lower than a predetermined level because the passed time was longer, it is possible to determine the liquid end before the liquid of the lower density is used.

Preferably, the liquid consumption is a sum of a volume of the liquid jetted from the nozzle and a volume of the liquid absorbed from the nozzle.

In addition, this invention is a liquid jetting apparatus comprising: a container-setting portion at which a liquid container is set, the liquid container having a plurality of liquid chambers that contain a plurality of kinds of liquid respectively and a storing part that stores information about a time when the liquid container was manufactured; a head member having a plurality of nozzles; a plurality of liquid ways each of which can communicate with each of the plurality of liquid chambers of the liquid container set at the container-setting portion and each of the plurality of nozzles; a information reader that can read out the information stored in the storing part of the liquid container set at the container-setting portion; a plurality of liquid discharging units each of which can cause each of the plurality of kinds of liquid to be discharged from the plurality of the nozzles; and a liquid discharging controller that can control the plurality of liquid discharging units respectively based on the information about the time when the liquid container was manufactured read out by the information reader.

According to the above feature, since the respective liquid discharging units are controlled based on the information about the time when the liquid container was manufactured, respective suitable liquid discharging operations for the respective kinds of liquid can be conducted, for example when the liquid container is newly set.

Preferably, the liquid jetting apparatus further comprises a clock component that knows a present time, and the liquid discharging controller has: a calculating part that can calculate a passed time until the present time based on the information about the time when the liquid container was manufactured; and a main controlling part that can control the plurality of liquid discharging units respectively based on the passed time.

In the case, preferably, the main controlling part is adapted to control the plurality of liquid discharging units respectively when the liquid container is replaced with a new liquid container in such a manner that a volume of each of the plurality of kinds of liquid to be initially discharged is larger when the passed time calculated based on the information stored in the storing part of the new liquid container set at the container-setting portion is longer. Thus, if densities of the plurality of kinds of liquid initially supplied to the nozzles are higher than respective predetermined levels because the passed time is longer, by the respective liquid discharging operations, it is possible to discharge the respective kinds of liquid that are initially supplied to the nozzles and that have such higher densities.

In addition, preferably, the storing part of the liquid container also stores information about respective properties of the plurality of kinds of liquid contained in the plurality of liquid chambers of the liquid container. In the case, the liquid discharging controller is adapted to control the plurality of liquid discharging units respectively based on the information about the respective properties of the plurality of kinds of liquid. Thus, respective suitable liquid discharging operations can be conducted for the respective kinds of liquid.

In addition, this invention is a liquid jetting apparatus comprising: a container-setting portion at which a liquid container is set, the liquid container having a plurality of liquid chambers that contain a plurality of kinds of liquid respectively and a storing part that stores information about a time when the liquid container was manufactured; a head member having a plurality of nozzles; a plurality of liquid ways each of which can communicate with each of the plurality of liquid chambers of the liquid container set at the container-setting portion and each of the plurality of nozzles; a information reader that can read out the information stored in the storing part of the liquid container set at the container-setting portion; a plurality of liquid-consumption totaling units each of which can total each of liquid consumptions of the plurality of kinds of liquid from the plurality of the nozzles; and a liquid-end determining unit that can determine respective liquid ends for the respective kinds of liquid based on the information about the time when the liquid container was manufactured read out by the information reader and the respective liquid consumptions.

According to the above feature, since the respective liquid ends are determined (judged) based on the information about the time when the liquid container was manufactured and the respective liquid consumptions, the respective liquid ends can suitably correspond to densities of the respective kinds of liquid at respective predetermined levels.

Preferably, the liquid jetting apparatus comprises a clock component that knows a present time, and the liquid-end determining unit has: a calculating part that can calculate a passed time until the present time based on the information about the time when the liquid container was manufactured; and a main determining part that can determine the respective liquid ends for the respective kinds of liquid based on the passed time.

In the case, preferably, the main determining part is adapted to determine each of the respective liquid ends for the respective kinds of liquid correspondingly to a smaller liquid consumption when the passed time is longer. Thus, if density of a kind of running-short but still remaining liquid is lower than a predetermined level because the passed time was longer, it is possible to determine a liquid end for the kind of liquid before the kind of liquid being the lower density is used.

In the case too, preferably, each of the liquid consumptions is a sum of a volume of the liquid jetted from the nozzle and a volume of the liquid absorbed from the nozzle.

In addition, preferably, the storing part of the liquid container also stores information about respective properties of the plurality of kinds of liquid contained in the plurality of liquid chambers of the liquid container. In the case, preferably, the liquid-end determining unit is adapted to determine the respective liquid ends for the respective kinds of liquid based on the information about the respective properties of the plurality of kinds of liquid. Thus, respective suitable liquid ends can be determined for the respective kinds of liquid.

For example, the information about the time when the liquid container was manufactured may be a date when the liquid container was manufactured.

In addition, this invention is a liquid jetting apparatus comprising: a container-setting portion at which a liquid container is set, the liquid container having a liquid chamber that contains liquid and a storing part that stores information about a sedimentation (sinking) state of the liquid in the liquid chamber; a head member having a nozzle; a liquid way that can communicate with the liquid chamber of the liquid container set at the container-setting portion and the nozzle; a information reader that can read out the information stored in the storing part of the liquid container set at the container-setting portion; a liquid discharging unit that can cause the liquid to be discharged from the nozzle; and a liquid discharging controller that can control the liquid discharging unit based on the information about the sedimentation state of the liquid in the liquid chamber read out by the information reader.

According to the feature, since the liquid discharging unit is controlled based on the information about the sedimentation state of the liquid in the liquid chamber, a suitable liquid discharging operation can be conducted, for example when the liquid container is newly set.

Alternatively, this invention is a liquid jetting apparatus comprising: a container-setting portion at which a liquid container is set, the liquid container having a liquid chamber that contains liquid and a storing part that stores information about a sedimentation state of the liquid in the liquid chamber; a head member having a nozzle; a liquid way that can communicate with the liquid chamber of the liquid container set at the container-setting portion and the nozzle; a information reader that can read out the information stored in the storing part of the liquid container set at the container-setting portion; a liquid-consumption totaling unit that can total a liquid consumption from the nozzle; and a liquid-end determining unit that can determine a liquid end based on the information about the sedimentation state of the liquid in the liquid chamber read out by the information reader and the liquid consumption.

According to the above feature, since the liquid end is determined (judged) based on the information about the sedimentation state of the liquid in the liquid chamber and the liquid consumption, the liquid end can suitably correspond to density of the liquid at a predetermined level.

Alternatively, this invention is a liquid jetting apparatus comprising: a container-setting portion at which a liquid container is set, the liquid container having a plurality of liquid chambers that contain a plurality of kinds of liquid respectively and a storing part that stores information about respective sedimentation states of the plurality of kinds of liquid in the plurality of liquid chambers; a head member having a plurality of nozzles; a plurality of liquid ways each of which can communicate with each of the plurality of liquid chambers of the liquid container set at the container-setting portion and each of the plurality of nozzles; a information reader that can read out the information stored in the storing part of the liquid container set at the container-setting portion; a plurality of liquid discharging units each of which can cause each of the plurality of kinds of liquid to be discharged from the plurality of the nozzles; and a liquid discharging controller that can control the plurality of liquid discharging units respectively based on the information about the respective sedimentation states of the plurality of kinds of liquid in the plurality of liquid chambers read out by the information reader.

According to the above feature, since the respective liquid discharging unit are controlled based on the information about the respective sedimentation states of the plurality of kinds of liquid in the plurality of liquid chambers, respective suitable liquid discharging operations for the respective kinds of liquid can be conducted, for example when the liquid container is newly set.

Alternatively, this invention is a liquid jetting apparatus comprising: a container-setting portion at which a liquid container is set, the liquid container having a plurality of liquid chambers that contain a plurality of kinds of liquid respectively and a storing part that stores information about respective sedimentation states of the plurality of kinds of liquid in the plurality of liquid chambers; a head member having a plurality of nozzles; a plurality of liquid ways each of which can communicate with each of the plurality of liquid chambers of the liquid container set at the container-setting portion and each of the plurality of nozzles; a information reader that can read out the information stored in the storing part of the liquid container set at the container-setting portion; a plurality of liquid-consumption totaling units each of which can total each of liquid consumptions of the plurality of kinds of liquid from the plurality of the nozzles; and a liquid-end determining unit that can determine respective liquid ends for the respective kinds of liquid based on the information about the respective sedimentation states of the respective kinds of liquid in the plurality of liquid chambers read out by the information reader and the respective liquid consumptions.

According to the above feature, since the respective liquid ends are determined based on the information about the respective sedimentation states of the respective kinds of liquid in the plurality of liquid chambers and the respective liquid consumptions, the respective liquid ends can suitably correspond to densities of the respective kinds of liquid at respective predetermined levels.

In addition, the liquid discharging unit may be a cleaning unit that can cause the liquid to be absorbed from the nozzle. Alternatively, the liquid discharging unit may be a flushing unit that can cause the liquid to be jetted from the nozzle.

For example, the liquid contained in the liquid container is ink including pigment. In the case, the liquid container may contain the liquid by containing a foam material filled with the liquid.

Alternatively, this invention is a liquid jetting apparatus comprising: a container-setting portion at which a liquid container is set, the liquid container having a liquid chamber that contains liquid; a head member having a nozzle; a liquid way that can communicate with the liquid chamber of the liquid container set at the container-setting portion and the nozzle; a liquid discharging unit that can cause the liquid to be discharged from the nozzle; and a liquid discharging controller that can control the liquid discharging unit based on information about sedimentation-state of the liquid in the liquid chamber.

Preferably, the liquid jetting apparatus further comprises: a clock component that knows a present time; and a sedimentation-state acquiring unit that can acquire the information about sedimentation-state of the liquid in the liquid chamber; wherein the information about sedimentation-state of the liquid in the liquid chamber is information about a point of time that is a standard for judgement of the sedimentation-state; the liquid discharging controller has: a calculating part that can calculate a passed time until the present time based on the information about a point of time that is a standard for judgement of the sedimentation-state, and a main controlling part that can control the liquid discharging unit based on the passed time.

The information about a point of time that is a standard for judgement of the sedimentation-state may be stored in a storage unit provided in the liquid container, and the sedimentation-state acquiring unit is adapted to read out the information stored in the storage unit. Alternatively, the information about a point of time that is a standard for judgement of the sedimentation-state may be shown by a shape or appearance of an element provided in the liquid container, and the sedimentation-state acquiring unit is adapted to distinguish the shape or appearance.

The point of time that is a standard for judgement of the sedimentation-state may be a point of time when the liquid container was manufactured. For example, the information about the point of time when the liquid container was manufactured may be a date when the liquid container was manufactured.

Alternatively, the point of time that is a standard for judgement of the sedimentation-state may be a point of time when the liquid container was set at the container-setting portion. Preferably, the information about the point of time when the liquid container was set at the container-setting portion is stored in a storage unit provided in the liquid container, and the sedimentation-state acquiring unit is adapted to read out the information stored in the storage unit.

Alternatively, the point of time that is a standard for judgement of the sedimentation-state may be a point of time when the liquid was jetted previous time.

Alternatively, the point of time that is a standard for judgement of the sedimentation-state may be a point of time when the liquid container was stirred previous time.

Preferably, a liquid-consumption totaling unit that can total a liquid consumption from the nozzle, and a liquid-end determining unit that can determine a liquid end based on the information about a point of time that is a standard for judgement of the sedimentation-state and the liquid consumption.

More preferably, the liquid-end determining unit has: a calculating part that can calculate a passed time until the present time based on the information about a point of time that is a standard for judgement of the sedimentation-state, and a main determining part that can determine the liquid end based on the passed time.

More preferably, the main determining part is adapted to determine the liquid end correspondingly to a smaller liquid consumption when the passed time is longer.

The liquid discharging unit may be a cleaning unit that can cause the liquid to be absorbed from the nozzle.

The liquid discharging unit may be a flushing unit that can cause the liquid to be jetted from the nozzle.

The liquid container may contain the liquid by containing a foam material filled with the liquid.

The liquid contained in the liquid container may be ink including pigment.

Preferably, the liquid container further has a second liquid chamber that contains second liquid, the head member further has a second nozzle, the apparatus further comprises a second liquid way that can communicate with the second liquid chamber of the liquid container set at the container-setting portion and the second nozzle, the apparatus further comprises a second liquid discharging unit that can cause the second liquid to be discharged from the second nozzle, and the liquid discharging controller can control the second liquid discharging unit based on information about sedimentation-state of the second liquid in the second liquid chamber.

That is, this invention is a liquid jetting apparatus comprising: a container-setting portion at which a liquid container is set, the liquid container having a plurality of liquid chambers that contain a plurality of kinds of liquid respectively; a head member having a plurality of nozzles; a plurality of liquid ways each of which can communicate with each of the plurality of liquid chambers of the liquid container set at the container-setting portion and each of the plurality of nozzles; a plurality of liquid discharging units each of which can cause each of the plurality of kinds of liquid to be discharged from each of the plurality of the nozzles; and a liquid discharging controller that can control the plurality of liquid discharging units respectively based on information about respective sedimentation-states of the plurality of kinds of liquid in the plurality of liquid chambers.

Preferably, the liquid jetting apparatus further comprises: a clock component that knows a present time; and a sedimentation-state acquiring unit that can acquire the information about respective sedimentation-states of the plurality of kinds of liquid in the plurality of liquid chambers; wherein the information about respective sedimentation-states of the plurality of kinds of liquid in the plurality of liquid chambers is information about a point of time that is a standard for judgement of the sedimentation-states; the liquid discharging controller has: a calculating part that can calculate a passed time until the present time based on the information about a point of time that is a standard for judgement of the sedimentation-states, and a main controlling part that can control the plurality of liquid discharging units respectively based on the passed time.

The point of time that may be a standard for judgement of the sedimentation-states is a point of time when the liquid container was manufactured. For example, the information about the point of time when the liquid container was manufactured may be a date when the liquid container was manufactured.

Alternatively, the point of time that is a standard for judgement of the sedimentation-states may be a point of time when the liquid container was set at the container-setting portion. Preferably, the information about the point of time when the liquid container was set at the container-setting portion is stored in a storage unit provided in the liquid container, and the sedimentation-state acquiring unit is adapted to read out the information stored in the storage unit.

Alternatively, the information about the point of time that is a standard for judgement of the sedimentation-states may be information about points of time when the plurality of kinds of liquid were jetted previous time respectively.

Alternatively, the point of time that is a standard for judgement of the sedimentation-states is a point of time when the liquid container was stirred previous time.

Preferably, a plurality of liquid-consumption totaling units each of which can total each of liquid consumptions of the plurality of kinds of liquid from the plurality of the nozzles, and a liquid-end determining unit that can determine respective liquid ends for the respective kinds of liquid based on the information about a point of time that is a standard for judgement of the sedimentation-states and the respective liquid consumptions.

More preferably, the liquid-end determining unit has: a calculating part that can calculate a passed time until the present time based on the information about a point of time that is a standard for judgement of the sedimentation-states, and a main determining part that can determine the respective liquid ends based on the passed time.

More preferably, the main determining part is adapted to determine the respective liquid ends correspondingly to smaller liquid consumptions when the passed time is longer.

The plurality of liquid discharging units may be cleaning units that can cause the respective kinds of liquid to be absorbed from the plurality of nozzles.

The plurality of liquid discharging units may be flushing units that can cause the respective kinds of liquid to be jetted from the plurality of nozzles.

The liquid container may contain the respective kinds of liquid by containing foam materials filled with the respective kinds of liquid.

The respective kinds of liquid contained in the liquid container may be a plurality kinds of ink including pigment.

Alternatively, this invention is a liquid jetting apparatus comprising: a container-setting portion at which a liquid container is set, the liquid container having a liquid chamber that contains liquid, the liquid including a sinkable constituent; a head member having a nozzle; a liquid way that can communicate with the liquid chamber of the liquid container set at the container-setting portion and the nozzle; and a sedimentation-state acquiring unit that can acquire information about sedimentation-state of the liquid in the liquid chamber; wherein the information about sedimentation-state of the liquid in the liquid chamber is information about a point of time that is a standard for judgement of the sedimentation-state.

The point of time that is a standard for judgement of the sedimentation-state may be a point of time when the liquid container was manufactured.

Alternatively, the point of time that is a standard for judgement of the sedimentation-state may be a point of time when the liquid container was set at the container-setting portion.

Alternatively, the point of time that is a standard for judgement of the sedimentation-state may be a point of time when the liquid was jetted previous time.

Alternatively, the point of time that is a standard for judgement of the sedimentation-state may be a point of time when the liquid container was stirred previous time.

Preferably, the liquid jetting apparatus further comprises: a clock component that knows a present time, and a calculating part that can calculate a passed time until the present time based on the information about a point of time that is a standard for judgement of the sedimentation-state.

More preferably, the liquid jetting apparatus further comprises: a liquid discharging unit that can cause the liquid to be discharged from the nozzle, and a main controlling part that can control the liquid discharging unit based on the passed time.

More preferably, the main controlling part is adapted to control the liquid discharging unit when the liquid container is replaced with a new liquid container in such a manner that a volume of the liquid to be initially discharged is larger when the passed time calculated based on the information about sedimentation-state of the liquid in the liquid chamber of the new liquid container set at the container-setting portion is longer.

Alternatively, the liquid jetting apparatus may further comprise: a liquid discharging unit that can cause the liquid to be discharged from the nozzle, and a main controlling part that can estimate the sedimentation-state based on the information about a point of time that is a standard for judgement of the sedimentation-state and information about easiness of sedimentation of the sinkable constituent in the liquid, and that can control the liquid discharging unit based on the estimated sedimentation-state.

Alternatively, this invention is a liquid jetting apparatus comprising: a container-setting portion at which a liquid container is set, the liquid container having a plurality of liquid chambers that contain a plurality of kinds of liquid respectively, each of the plurality of kinds of liquid including a sinkable constituent; a head member having a plurality of nozzles; a plurality of liquid ways each of which can communicate with each of the plurality of liquid chambers of the liquid container set at the container-setting portion and each of the plurality of nozzles; and a sedimentation-state acquiring unit that can acquire information about respective sedimentation-states of the plurality of kinds of liquid in the plurality of liquid chambers; wherein the information about respective sedimentation-states of the plurality of kinds of liquid in the plurality of liquid chambers is information about a point of time that is a standard for judgement of the sedimentation-states, and the point of time that is a standard for judgement of the sedimentation-states is a point of time when the liquid container was manufactured.

Alternatively, this invention is a liquid jetting apparatus comprising: a container-setting portion at which a liquid container is set, the liquid container having a plurality of liquid chambers that contain a plurality of kinds of liquid respectively, each of the plurality of kinds of liquid including a sinkable constituent; a head member having a plurality of nozzles; a plurality of liquid ways each of which can communicate with each of the plurality of liquid chambers of the liquid container set at the container-setting portion and each of the plurality of nozzles; and a sedimentation-state acquiring unit that can acquire information about respective sedimentation-states of the plurality of kinds of liquid in the plurality of liquid chambers; wherein the information about respective sedimentation-states of the plurality of kinds of liquid in the plurality of liquid chambers is information about a point of time that is a standard for judgement of the sedimentation-states, and the point of time that is a standard for judgement of the sedimentation-states is a point of time when the liquid container was set at the container-setting portion.

Alternatively, this invention is a liquid jetting apparatus comprising: a container-setting portion at which a liquid container is set, the liquid container having a plurality of liquid chambers that contain a plurality of kinds of liquid respectively, each of the plurality of kinds of liquid including a sinkable constituent; a head member having a plurality of nozzles; a plurality of liquid ways each of which can communicate with each of the plurality of liquid chambers of the liquid container set at the container-setting portion and each of the plurality of nozzles; and a sedimentation-state acquiring unit that can acquire information about respective sedimentation-states of the plurality of kinds of liquid in the plurality of liquid chambers; wherein the information about respective sedimentation-states of the plurality of kinds of liquid in the plurality of liquid chambers is information about a point of time that is a standard for judgement of the sedimentation-states, and the information about a point of time that is a standard for judgement of the sedimentation-states is information about points of time when the plurality of kinds of liquid were jetted previous time respectively.

Alternatively, this invention is a liquid jetting apparatus comprising: a container-setting portion at which a liquid container is set, the liquid container having a plurality of liquid chambers that contain a plurality of kinds of liquid respectively, each of the plurality of kinds of liquid including a sinkable constituent; a head member having a plurality of nozzles; a plurality of liquid ways each of which can communicate with each of the plurality of liquid chambers of the liquid container set at the container-setting portion and each of the plurality of nozzles; and a sedimentation-state acquiring unit that can acquire information about respective sedimentation-states of the plurality of kinds of liquid in the plurality of liquid chambers; wherein the information about respective sedimentation-states of the plurality of kinds of liquid in the plurality of liquid chambers is information about a point of time that is a standard for judgement of the sedimentation-states, and the point of time that is a standard for judgement of the sedimentation-states is a point of time when the liquid container was stirred previous time.

Preferably, a plurality of liquid discharging units each of which can cause each of the plurality of kinds of liquid to be discharged from each of the plurality of the nozzles, and a main controlling part that can estimate the sedimentation-states based on the information about a point of time that is a standard for judgement of the sedimentation-states and information about easiness of sedimentation of the sinkable constituent in each of the plurality of kinds of liquid, and that can control the plurality of liquid discharging units respectively based on the estimated sedimentation-states.

BEST MODE FOR CARRYING OUT THE INVENTION

Embodiments of the invention will now be described in more detail with reference to drawings.

Figure 1:
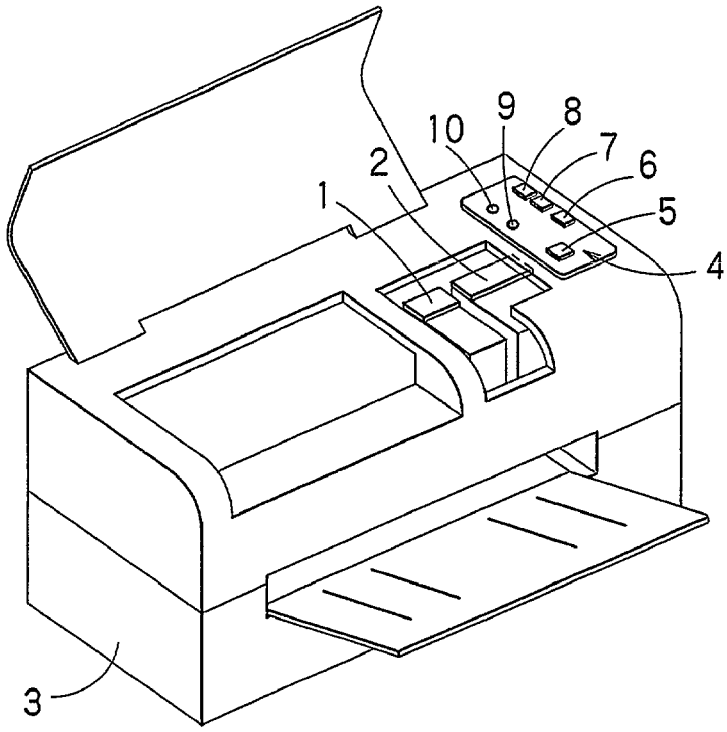
FIG. 1 is a schematic perspective view of a first embodiment of an ink-jet recording apparatus according to the invention.
Figure 2:
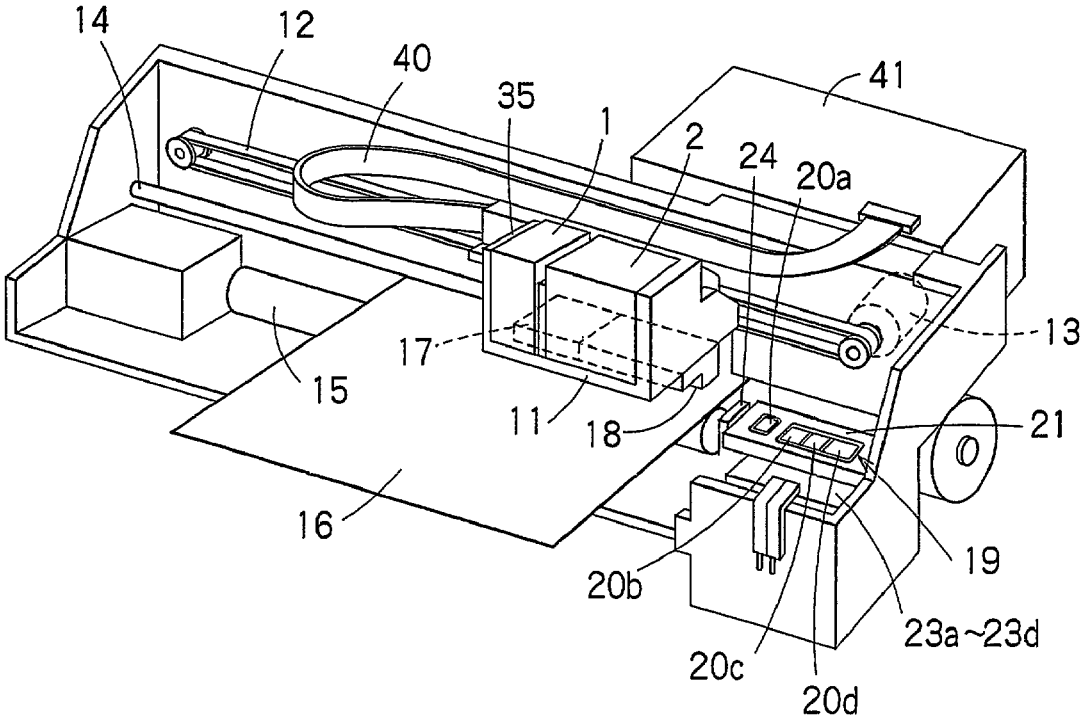
FIG. 2 is a schematic view of a printing mechanism in the ink-jet recording apparatus shown in FIG. 1.

FIG. 1 is a schematic perspective view of a first embodiment of an ink-jet recording apparatus according to the invention, which is an example of liquid jetting apparatus. FIG. 2 is a schematic view of a printing mechanism in the ink-jet recording apparatus. As shown in FIGS. 1 and 2, the ink-jet recording apparatus of the first embodiment comprises a housing 3 and a carriage 11 on which a black-ink cartridge 1 (liquid container) and a color-ink cartridge 2 (liquid container) are placed on.

As shown in FIG. 1, an operation panel 4 is arranged on an upper surface of the housing 3. In the case, the operation panel 4 includes: a power switch 5, a ink-cartridge replacement requesting switch 6, a black-ink cleaning requesting switch 7, a color-ink cleaning requesting switch 8, a black-ink ink-end display 9 and a color-ink ink-end display 10.

As shown in FIG. 2, the carriage 11 is connected to a carriage-driving motor 13 via a timing belt 12. In addition, the carriage 11 is slidably supported by a guide member 14. The guide member 14 extends in parallel to a platen 15. Thus, the carriage 11 is movable in parallel to the platen 15. The direction in which the carriage is movable is called a main scanning direction.

A black-ink recording head 17 having a plurality of nozzles for jetting black ink and a color-ink recording head 18 having a plurality of nozzles for respectively jetting yellow ink, magenta ink and cyan ink are provided at a lowest portion of the carriage 11.

A recording medium 16 such as a recording paper is supported in such a manner that the black-ink recording head 17 and the color-ink recording head 18 face to face with the recording medium 16. In addition, the recording medium 16 is movable in a direction perpendicular to the main scanning direction. The direction in which the recording medium is movable is called a sub-scanning direction.

A capping unit 19 (cleaning unit) is arranged at a portion where no recording operation is conducted by the recording heads 17 and 18 (a right-side portion in FIG. 2). The capping unit 19 has a cap 20*a* for sealing the nozzles of the black-ink recording head 17 and caps 20*b*–20*d* for sealing the nozzles of the respective colors of the color-ink recording head 18.

In the case, the caps 20*a*–20*d* are mounted on the same slider 21, and are respectively connected to four pump units 23*a*–23*d* (cleaning unit) that are driven by motors or the like via respective tubes (not shown). Thus, the caps 20*a*–20*d* can be independently supplied negative pressure in order to respectively absorb ink from the nozzles of the respective colors of the corresponding recording heads 17 and 18, that is, in order to conduct respective cleaning operations (liquid-discharging operations).

Figure 3:
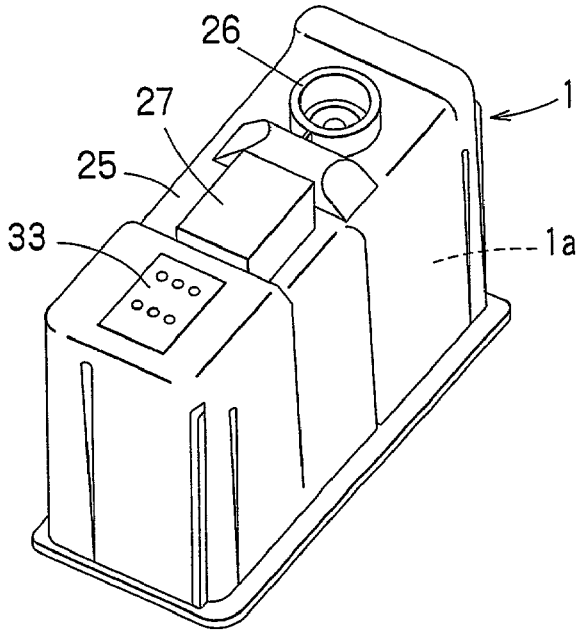
FIG. 3 is a schematic perspective view of an example of black-ink cartridge.

FIG. 3 is a schematic perspective view of the black-ink cartridge 1. As shown in FIG. 3, the black-ink cartridge 1 has an ink chamber 1*a* that contains black ink. An ink supplying port 26, which can connect the ink chamber 1*a* and an ink way 17*a* of the black-ink recording head 17, is provided at a base portion 25 of the black-ink cartridge 1. In addition, a semiconductor storing means 27 (storing part), which is a memory capable of rewriting data electrically, is provided on the base portion 25. Furthermore, an electrical terminal 33 for accessing the semiconductor storing means 27 is also provided on the base portion 25.

In the case, the semiconductor storing means 27 stores information about a time when the black-ink cartridge 1 was manufactured, for example a date when the black-ink cartridge 1 was manufactured. In addition, the semiconductor storing means 27 stores information about characteristics of the black ink contained in the ink chamber 1*a*, including easiness of sedimentation of black pigment in the black ink. The ink chamber 1*a* contains the black ink by containing a foam member filled with the black pigment ink.

Figure 4:
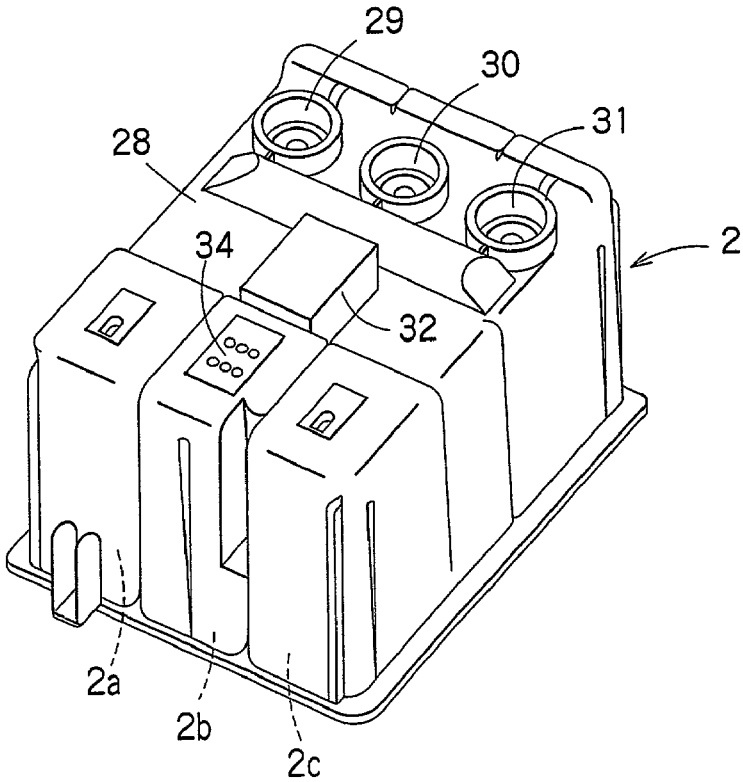
FIG. 4 is a schematic perspective view of an example of three-color-ink cartridge.

FIG. 4 is a schematic perspective view of the color-ink cartridge 2. As shown in FIG. 4, the color-ink cartridge 2 has ink chambers 2*a*, 2*b* and 2*c* that separately contain yellow ink, magenta ink and cyan ink, respectively. Ink supplying ports 29–31, which can connect the respective ink chambers 2*a*, 2*b* and 2*c* and respective ink ways 18*a* of the color-ink recording head 18, are provided at a base portion 28 of the color-ink cartridge 2. In addition, a semiconductor storing means 32 (storing part), which is a memory capable of rewriting data electrically, is provided on the base portion 28. Furthermore, an electrical terminal 34 for accessing the semiconductor storing means 32 is also provided on the base portion 28.

In the case, the semiconductor storing means 32 stores information about a time when the color-ink cartridge 2 was manufactured, for example a date when the color-ink cartridge 2 was manufactured. In addition, the semiconductor storing means 32 stores information about characteristics of the respective inks contained in the respective ink chambers 2*a*–2*c*, including easiness of sedimentation of respective color pigment in the respective inks. Each of the ink chambers 2*a*–2*c* contains the color ink by containing a foam member filled with the color pigment ink.

Figure 5:
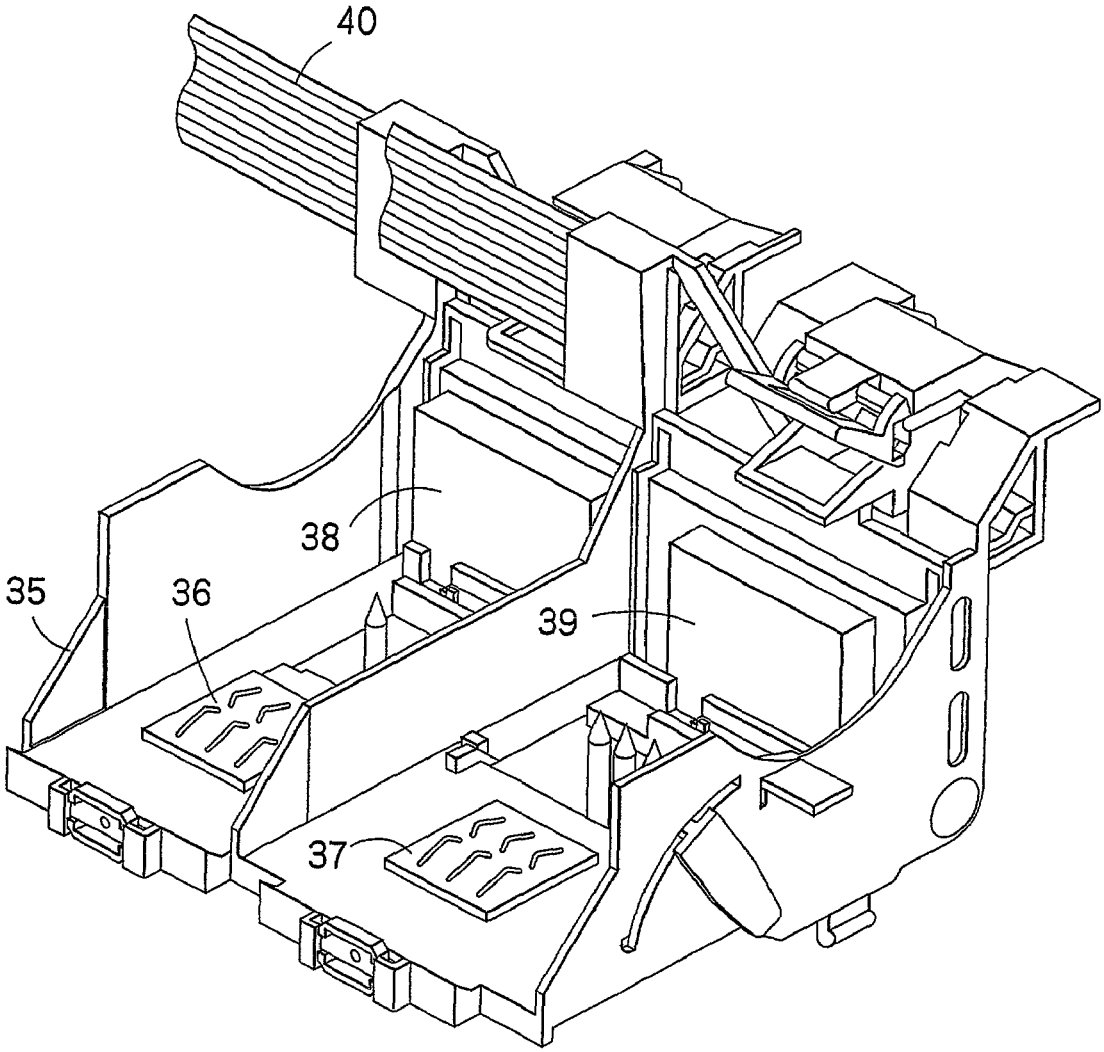
FIG. 5 is a schematic perspective view of an example of holder at which the ink cartridges are set.

FIG. 5 is a schematic perspective view of a head holder 35 (container-setting portion) at which the ink cartridges 1 and 2 shown in FIGS. 3 and 4 are set. As shown in FIG. 5, the head holder 35 is provided with electrical terminals 36 and 37, which can be electrically connected to the electrical terminals 33 and 34 of the ink cartridges 1 and 2. The electrical terminals 36 and 37 are connected to information readers 38 and 39 that can read out the information stored in the semiconductor storing means 27 and 32, respectively. The information readers 38 and 39 are connected to a controlling unit 41 (see FIG. 2) of a recording apparatus body via flexible cables.

Each of the semiconductor storing means 27 and 32 may be a read-only memory that is not capable of rewriting data. Alternatively, if each of the semiconductor storing means 27 and 32 is capable of rewriting data, the information reader 38*s* and 39 may have a function to rewrite data into the semiconductor storing means 27 and 32.

In detail, each of the semiconductor storing means 27 and 32 may be an IC chip. Alternatively, each of the semiconductor storing means 27 and 32 may be replaced with any other storing member such as a bar code or a magnetic tape. In the case, the information readers 38 and 39 may be modified to match with the replaced storing member.

Figure 6:
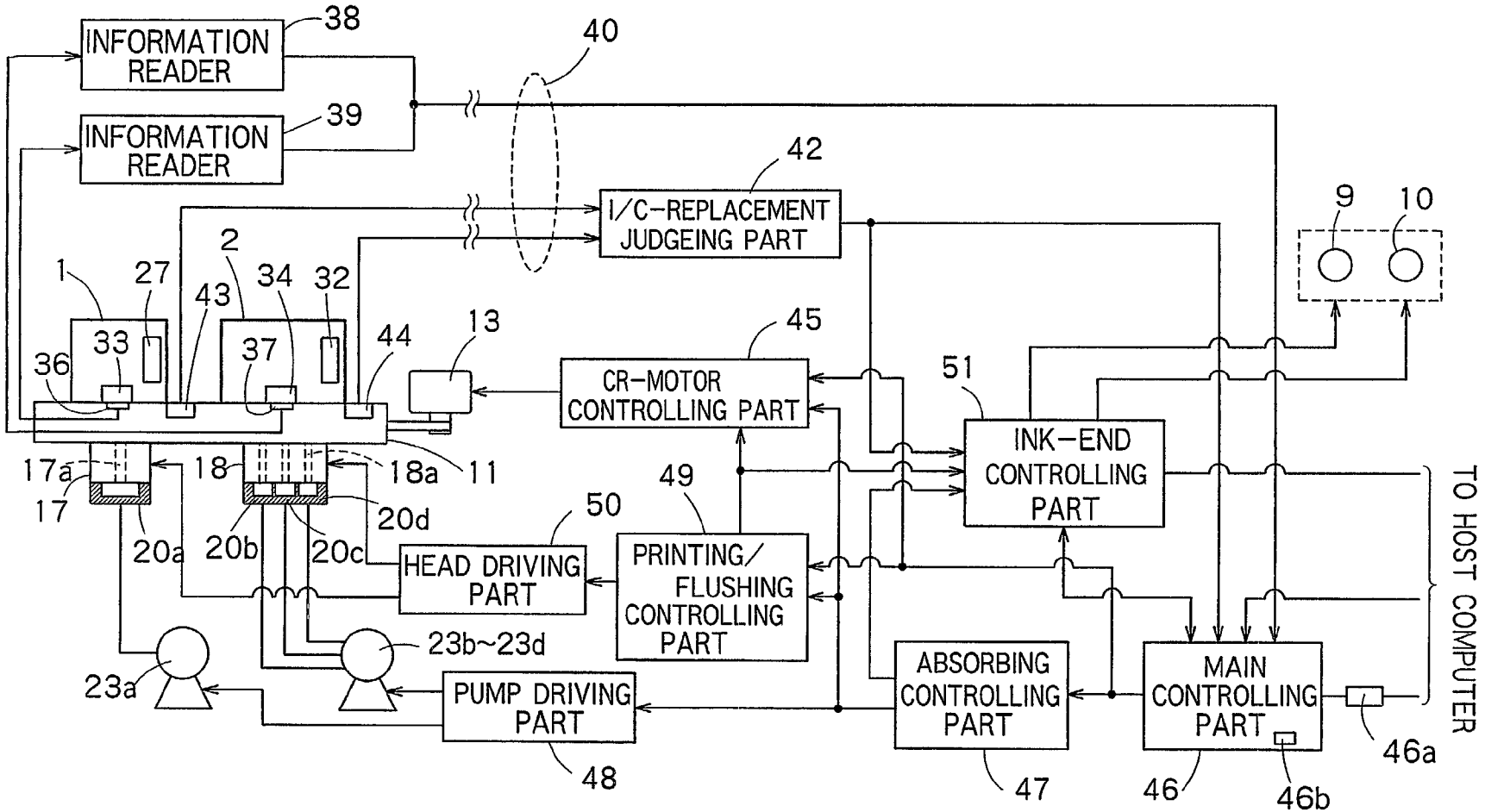
FIG. 6 is a schematic block diagram of a controlling system of the ink-jet recording apparatus shown in FIG. 1.

FIG. 6 is a schematic block diagram of the controlling unit 41. As shown in FIG. 6, push switches 43 and 44 are provided on the carriage 11 in such a manner that the push switches 43 and 44 are respectively pushed by the ink cartridges 1 and 2 while the ink cartridges 1 and 2 are set. The push switches 43 and 44 are connected to an ink-cartridge-replacement judging part 42, which can judge whether the respective ink cartridges 1 and 2 have been replaced or not.

A carriage-motor controlling part 45 is adapted to receive a control instruction from a main controlling part 46 and cause the carriage 11 to move in parallel to the platen 15.

An absorbing controlling part 47 (a main controlling part of cleaning (liquid discharging) controller) is adapted to receive a control instruction from a main controlling part 46, cause the capping unit 19 to seal the nozzles of the recording heads 17 and 18 via the carriage-motor controlling part 45 and control respective absorbing powers and/or times of the respective absorbing pumps 23*a*–23*d* via a pump driving part 48.

A printing/flushing controlling part 49 is adapted to operate a head driving part 50 based on recording data from a host computer (not shown) in order to suitably jet ink drops from the nozzles of the recording heads 17 and 18 to perform a printing operation. In addition, the printing/flushing controlling part 49 is also adapted to operate the head driving part 50 based on level of increased viscosity of the ink in order to cause the ink in the nozzles of the recording heads 17 and 18 to minutely vibrate to perform a flushing operation.

The main controlling part 46 is adapted to control the carriage-motor controlling part 45, the printing/flushing controlling part 49 and the absorbing controlling part 47, based on recording data from the host computer (not shown) or the like. In addition, the main controlling part 46 is also connected to a clock component 46*a* that knows a present time. The clock component 46*a* may have a clock function. Alternatively, the clock component 46*a* may obtain the present time or any other clock information from the host computer.

Herein, when the ink-cartridge-replacement judging part 42 judges that the black-ink cartridge 1 has been changed, the main controlling part 46 of the embodiment is adapted to obtain the information stored in the semiconductor storing means 27 of the new black-ink cartridge 1, that is, the date when the black-ink cartridge 1 was manufactured (the date of manufacture) and the information about characteristics of the black ink contained in the black-ink cartridge 1, via the information reader 38.

Then, a calculating part 46*b* in the main controlling part 46 (a calculating part in the cleaning (liquid-discharging) controller and a calculating part in an ink-end determining unit) is adapted to calculate a passed time until the present time based on the obtained date of manufacture.

Then, the calculating part 46*b* is adapted to calculate a volume of the ink to be initially absorbed and an estimated ink consumption, based on the passed time. A concrete way of the calculation is explained with reference to FIG. 7.

Figure 7:
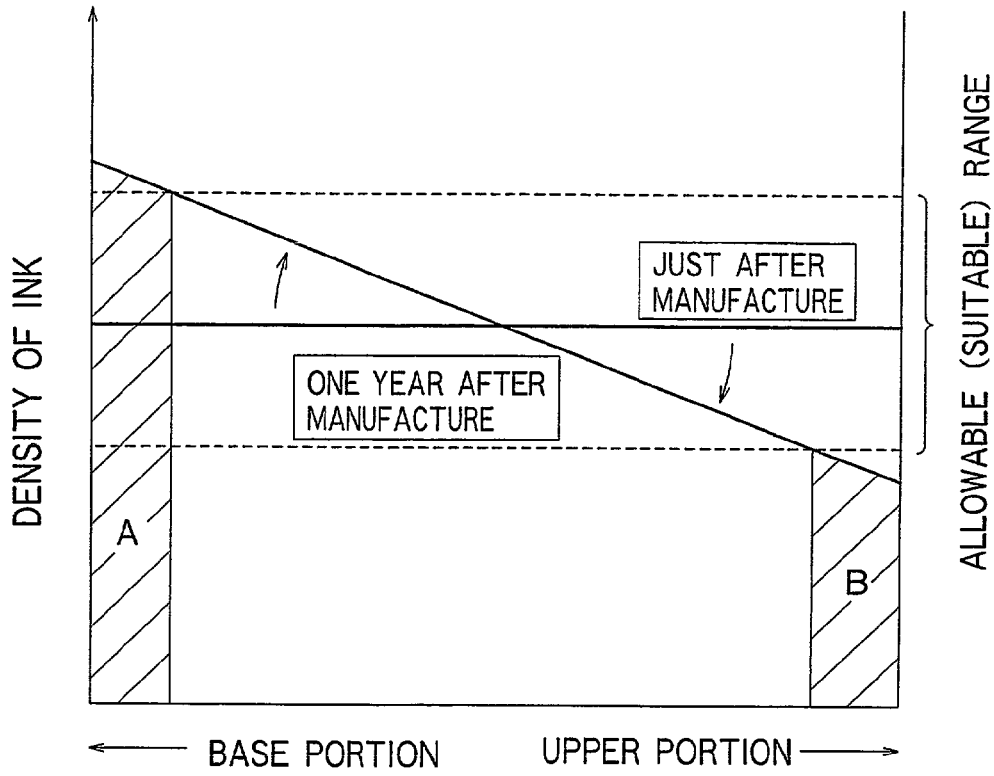
FIG. 7 is a view for explaining a change of density of ink in the ink cartridge.

As shown in FIG. 7, the black ink contained in the ink chamber 1*a* of the ink cartridge 1 just after manufactured has substantially the same density at an upper portion thereof and at a base portion thereof. However, if the ink cartridge has been stored at a predetermined attitude (wherein the ink supplying port 26 is lowered) for a ling time since the ink cartridge was manufactured, pigment in the ink may sink because of gravity. Thus, as shown by an arrow in FIG. 7, density of the ink at the base portion of the ink chamber 1*a* becomes higher, and density of the ink at the upper portion thereof becomes lower.

Thus, if a predetermined time or more has passed since the ink cartridge was manufactured, density of the ink A at the base portion of the ink chamber 1*a* is so high that it is difficult to perform the recording operation at a high quality. Thus, in order to discharge the ink A by the cleaning operation, the volume of the ink to be initially absorbed (discharged) is set more by a region A according to the passed time.

The main controlling part 46 and the absorbing controlling part 47 are adapted to control the absorbing pump 23*a* based on the volume of the ink to be initially absorbed, in order to perform an ink-filling operation when the new ink cartridge is set on.

On the other hand, if the predetermined time or more has passed since the ink cartridge was manufactured, density of the ink B at the upper portion of the ink chamber 1*a* is so low that it is difficult to perform the recording operation at a high quality. Thus, in order to positively avoid using the ink B, the estimated ink consumption is set less by a region B.

The main controlling part 46 is adapted to send the estimated ink consumption to an ink-end controlling part 51. The ink-end controlling part 51 is explained later.

Similarly, when the ink-cartridge-replacement judging part 42 judges that the color-ink cartridge 2 has been changed, the main controlling part 46 of the embodiment is adapted to obtain the information stored in the semiconductor storing means 32 of the new color-ink cartridge 2, that is, the date when the color-ink cartridge 2 was manufactured (the date of manufacture) and the information about characteristics of the respective inks contained in the color-ink cartridge 2, via the information reader 39.

Then, the calculating part 46*b* in the main controlling part 46 is adapted to calculate a passed time until the present time based on the obtained date of manufacture.

Then, the calculating part 46*b* is adapted to calculate volumes of the respective inks to be initially absorbed and respective estimated ink consumptions for the respective inks, based on the passed time. A concrete way of the calculation is substantially the same as the above way explained with reference to FIG. 7.

That is, as shown in FIG. 7, the respective inks contained in the respective ink chambers 2*a*–2*c* of the ink cartridge 2 just after manufactured have substantially the same density at upper portions thereof and at base portions thereof, respectively. However, if the ink cartridge has been stored at a predetermined attitude (wherein the ink supplying ports 29–31 are lowered) for a ling time since the ink cartridge was manufactured, pigment in the respective inks may sink because of gravity. Thus, densities of the inks at the base portions of the ink chambers 2*a*–2*c* become higher, and densities of the inks at the upper portions thereof become lower.

Thus, if a predetermined time or more has passed since the ink cartridge was manufactured, density of the ink A at each base portion of the ink chambers 2*a*–2*c* is so high that it is difficult to perform the recording operation at a high quality. Thus, in order to discharge the ink A by the cleaning operation the volumes of the respective inks to be initially absorbed (discharged) are set more by a region A according to the passed time.

The main controlling part 46 and the absorbing controlling part 47 are adapted to control the absorbing pumps 23*b*–23*d* based on the volumes of the respective inks to be initially absorbed, in order to perform ink-filling operations for the respective inks when the new ink cartridge is set on.

On the other hand, if the predetermined time or more has passed since the ink cartridge was manufactured, density of the ink B at each upper portion of the ink chambers 2*a*–2*c* is so low that it is difficult to perform the recording operation at a high quality. Thus, in order to positively avoid using the ink B, the estimated ink consumptions are set less by a region B.

The main controlling part 46 is adapted to send the estimated ink consumptions to the ink-end controlling part 51.

Figure 8:
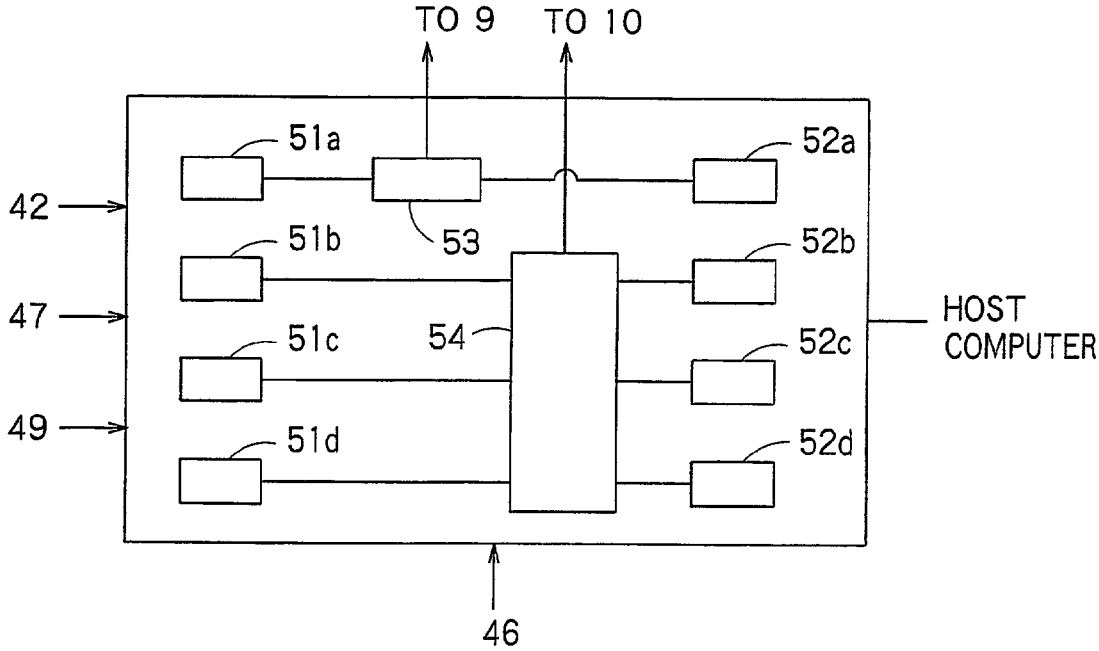
FIG. 8 is a schematic block diagram of a ink-end controller shown in FIG. 6.

The ink-end controlling part 51 is explained with reference to FIG. 8, which is a schematic block diagram of the ink-end controlling part 51. As shown in FIG. 8, the ink-end controlling part 51 has: a black-ink-consumption totaling part 51*a* that can total a black-ink consumption; an estimated-black-ink-consumption storing part 52*a;* respective color-ink-consumption totaling parts 51*b*–51*d* that can respectively total respective color-ink consumptions; respective estimated-color-ink-consumption storing parts 52*b*–52*d* for the respective color inks; a remaining-black-ink comparing part 53; and a remaining-color-ink comparing part 54.

Each of the ink-consumption totaling parts 5l*a*–51*d* is adapted to total the ink consumption by adding a volume of the ink jetted for the recording operation (a sum of the products of the number of jetting and jetted volume per jetting) and a volume of the ink absorbed in the cleaning operation.

Each of the estimated ink-consumption storing parts 52*a*–52*d* is adapted to store each value (estimated ink consumption) sent from the main controlling part 46.

The remaining-black-ink comparing part 53 (a main determining part of a liquid-end determining unit) is adapted to compare the black-ink consumption totaled by the black-ink-consumption totaling part 51*a* with the estimated black-ink consumption stored in the estimated-black-ink-consumption storing part 52*a*. If the former value (consumption) is more than the later value (consumption), the remaining-black-ink comparing part 53 is adapted to judge an ink-end for the black ink and send a signal of the judgement to the black-ink ink-end display 9.

The remaining-color-ink comparing part 54 (a main determining part of a liquid-end determining unit) is adapted to compare the respective color-ink consumptions totaled by the respective color-ink-consumption totaling parts 51*b*–51*d* with the respective estimated color-ink consumptions stored in the respective estimated-color-ink-consumption storing parts 52*b*–52*d*. Regarding at least one ink (color), if the former value (consumption) is more than the later value (consumption), the remaining-color-ink comparing part 54 is adapted to judge an ink-end for the ink and send a signal of the judgement to the color-ink ink-end display 10.

Next, an operation of the above embodiment is explained.

When a new black-ink cartridge 1 is set (when a black-ink cartridge is replaced with a new black-ink cartridge 1), the ink-cartridge-replacement judging part 42 judges that the new black-ink cartridge 1 is set, based on a signal from the push switch 43.

Then, the main controlling part 46 obtains the information stored in the semiconductor storing means 27 of the new black-ink cartridge 1, that is, the date when the black-ink cartridge 1 was manufactured (the date of manufacture) and the information about characteristics of the black ink contained in the black-ink cartridge 1, via the information reader 38.

Then, the calculating part 46*b* provided in the main controlling part 46 calculates a passed time until the present time based on the obtained date of manufacture. In addition, the calculating part 46*b* calculates a volume of the black ink to be initially absorbed and an estimated black-ink consumption, based on the passed time.

If a predetermined time or more has passed since the ink cartridge was manufactured, density of the ink A at the base portion of the ink chamber 1*a* (see FIG. 7) is so high that it is difficult to perform the recording operation at a high quality. Thus, in order to discharge the ink A by the cleaning operation, the volume of the ink to be initially absorbed (discharged) is set more by the region A according to the passed time.

On the contrary, if the predetermined time or more has passed since the ink cartridge was manufactured, density of the ink B at the upper portion of the ink chamber 1*a* (see FIG. 7) is so low that it is difficult to perform the recording operation at a high quality. Thus, in order to positively avoid using the ink B, the estimated ink consumption is set less by the region B. The main controlling part 46 sends the estimated ink consumption to the ink-end controlling part 51, in order to cause the estimated-black-ink-consumption storing part 52*a* to store the estimated ink consumption.

The main controlling part 46 and the absorbing controlling part 47 controls the absorbing pump 23*a* based on the set volume of the ink to be initially absorbed, in order to perform an ink-filling operation when the new ink cartridge is set on.

After that, while the recording apparatus is used, the ink-consumption totaling part 51*a* totals the black-ink consumption by adding a volume of the black ink jetted from the nozzles for the recording operation (a sum of the products of the number of jetting and jetted volume per jetting) and a volume of the black ink absorbed in the cleaning operation.

Then, the remaining-black-ink comparing part 53 compares the black-ink consumption totaled by the black-ink-consumption totaling part 51*a* with the estimated black-ink consumption stored in the estimated-black-ink-consumption storing part 52*a*. If the former value (consumption) is more than the later value (consumption), the remaining-black-ink comparing part 53 judges an ink-end for the black ink and sends a signal of the judgement to the black-ink ink-end display 9.

Similarly, when a new color-ink cartridge 2 is set (when a color-ink cartridge is replaced with a new color-ink cartridge 2), the ink-cartridge-replacement judging part 42 judges that the new color-ink cartridge 2 is set, based on a signal from the push switch 44.

Then, the main controlling part 46 obtains the information stored in the semiconductor storing means 32 of the new color-ink cartridge 2, that is, the date when the color-ink cartridge 2 was manufactured (the date of manufacture) and the information about characteristics of the respective inks contained in the color-ink cartridge 2, via the information reader 39.

Then, the calculating part 46*b* provided in the main controlling part 46 calculates a passed time until the present time based on the obtained date of manufacture. In addition, the calculating part 46*b* calculates volumes of the respective color inks to be initially absorbed and respective estimated ink consumptions for the respective color inks, based on the passed time.

If a predetermined time or more has passed since the ink cartridge was manufactured, density of the ink A at each base portion of the ink chambers 2*a*–2*c* (see FIG. 7) is so high that it is difficult to perform the recording operation at a high quality. Thus, in order to discharge the ink A by the cleaning operation, the volumes of the respective inks to be initially absorbed (discharged) are set more by the region A according to the passed time.

On the contrary, if the predetermined time or more has passed since the ink cartridge was manufactured, density of the ink B at each upper portion of the ink chambers 2*a*–2*c* (see FIG. 7) is so low that it is difficult to perform the recording operation at a high quality. Thus, in order to positively avoid using the ink B, the estimated ink consumptions for the respective inks are set less by the region B. The main controlling part 46 sends the estimated ink consumptions to the ink-end controlling part 51, in order to cause the respective estimated-color-ink-consumption storing parts 52*b*–52*d* to store the estimated ink consumptions, respectively.

The main controlling part 46 and the absorbing controlling part 47 controls the absorbing pumps 23*b*–23*d* based on the set volumes of the respective inks to be initially absorbed, in order to perform ink-filling operations for the respective inks when the new ink cartridge is set on.

After that, while the recording apparatus is used, each of the ink-consumption totaling parts 51*b*–51*d* totals each color-ink consumption by adding a volume of each color-ink jetted from the nozzles for the recording operation (a sum of the products of the number of jetting and jetted volume per jetting) and a volume of each color-ink absorbed in the cleaning operation.

Then, the remaining-color-ink comparing part 54 compares the respective color-ink consumptions totaled by the color-ink-consumption totaling parts 51*b*–51*d* with the respective estimated color-ink consumptions stored in the estimated-color-ink-consumption storing parts 52*b*–52*d*. Regarding at least one ink (color), if the former value (consumption) is more than the later value (consumption), the remaining-color-ink comparing part 54 judges an ink-end for the ink and sends a signal of the judgement to the color-ink ink-end display 10.

As described above, according to the embodiment, the absorbing pumps 23*a*–23*d* may be controlled based on the information about the time when the ink cartridge 1 and/or 2 was manufactured. Thus, suitable ink-filling operations can be performed when the new ink cartridge 1 and/or 2 is set on.

In the embodiment, the calculating part 46*b* can calculate the passed time from the date when the ink cartridge 1 or 2 was manufactured until the present time. In addition, the absorbing pumps 23*a*–23*d* can be controlled in such a manner that the volumes of the respective inks to be initially absorbed are more according to the passed time. Thus, if density of the ink initially introduced to the nozzles is higher than a predetermined level because the passed time from the time of manufacture is longer, the ink having such a higher density can be discharged by the cleaning (absorbing) operation.

Furthermore, regarding the color-ink cartridge 2, for the respective color inks contained in the respective ink chambers 2*a*–2*c*, the absorbing pumps 23*b*–23*d* may be independently controlled based on the information about the time when the ink cartridge 2 was manufactured. Thus, suitable ink-filling operations for the respective color inks can be performed when the new ink cartridge 2 is set on.

In addition, according to the embodiment, the ink end can be determined based on the information about the time when the ink cartridge 1 and/or 2 was manufactured and the ink consumption. Thus, the ink end can suitably correspond to density of the ink at a predetermined level.

In the embodiment, the calculating part 46*b* can calculate the passed time from the date when the ink cartridge 1 or 2 was manufactured until the present time. In addition, the ink end can be determined correspondingly to smaller ink consumption when the passed time is longer. Thus, if density of running-short but still remaining ink is lower than a predetermined level because the passed time is longer, it is possible to determine (judge) the ink end before the ink having such a lower density is used.

Furthermore, regarding the color-ink cartridge 2, for the respective color inks contained in the respective ink chambers 2*a*–2*c*, the ink ends may be independently determined based on the information about the time when the ink cartridge 2 was manufactured and the respective ink consumptions. Thus, suitable ink ends for the respective color inks can be determined.

In addition, the ink consumption is the sum of the volume of the ink jetted from the nozzles and the volume of the ink absorbed from the nozzles. Thus, the ink consumption can be more correct.

Figure 9:
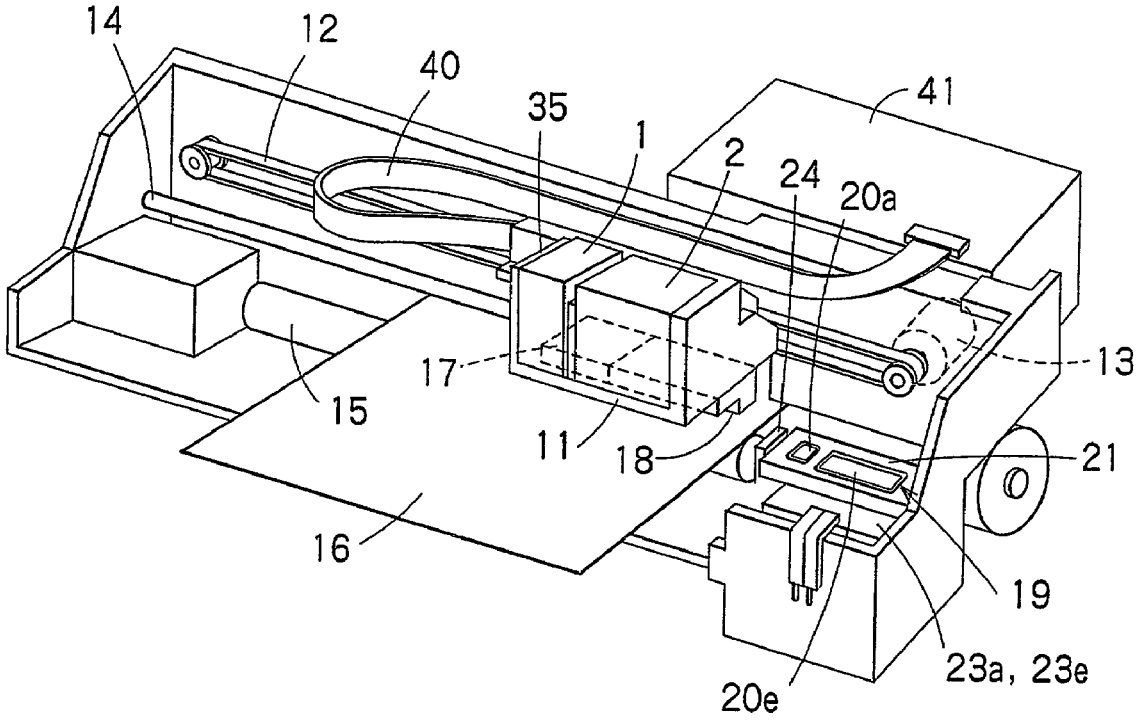
FIG. 9 is a schematic perspective view of a second embodiment of an ink-jet recording apparatus according to the invention.
Figure 10:
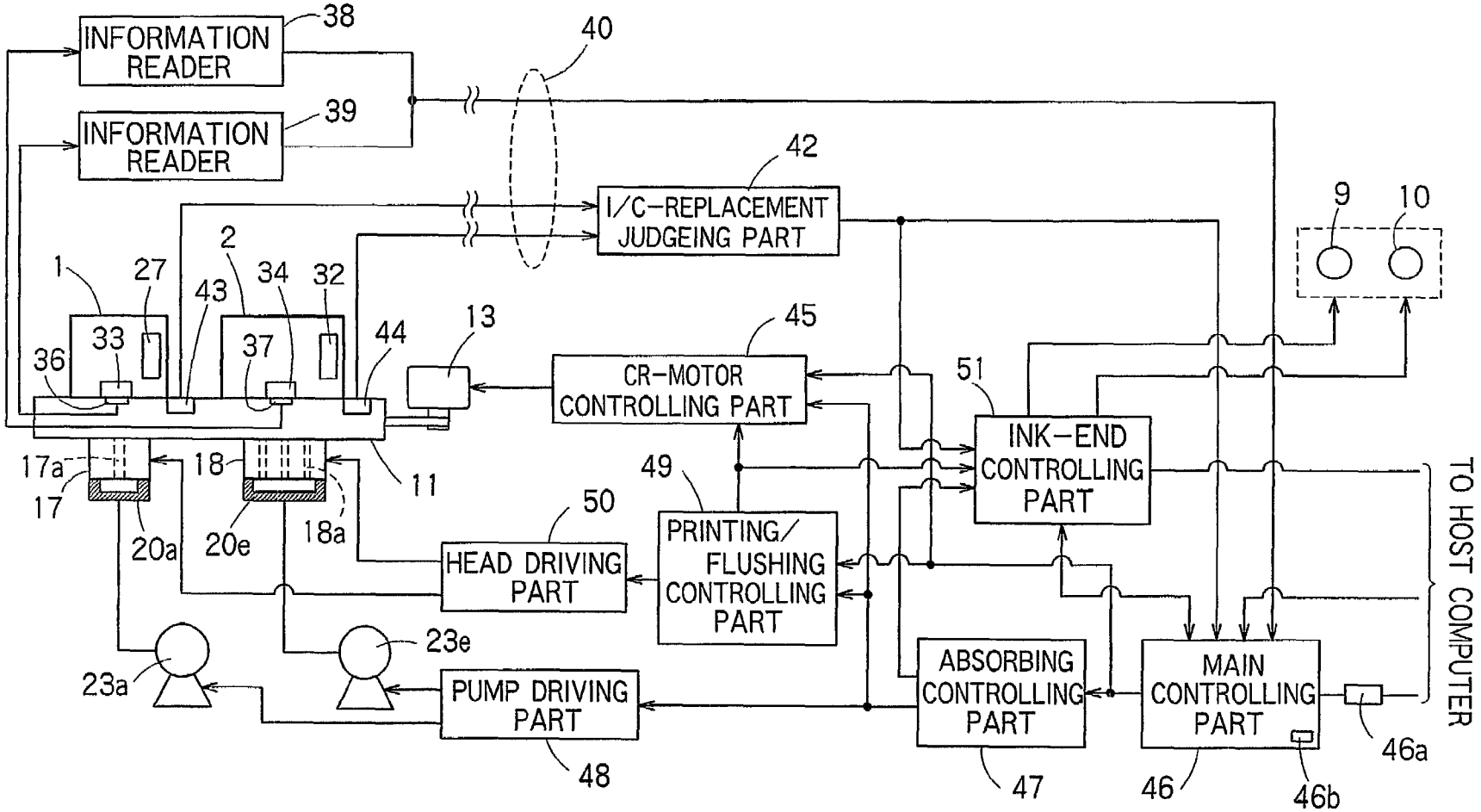
FIG. 10 is a schematic block diagram of a controlling system of the ink-jet recording apparatus shown in FIG. 9.

Next, an ink-jet recording apparatus in a second embodiment according to the invention is explained with reference to FIGS. 9 and 10. FIG. 9 is a schematic view of a printing mechanism in the ink-jet recording apparatus of the second embodiment. FIG. 10 is a schematic block diagram of a controlling system of the ink-jet recording apparatus shown in FIG. 9.

As shown in FIGS. 9 and 10, a capping unit 19 in the ink-jet recording apparatus of the second embodiment has a cap 20*a* for sealing the nozzles of the black-ink recording head 17 and a cap 20*e* for sealing in common the nozzles of the respective colors of the color-ink recording head 18.

In the case, the caps 20*a* and 20*e* are mounted on the same slider 21, and are respectively connected to two pump units 23*a* and 23*e* (cleaning unit) that are driven by motors or the like via respective tubes (not shown). Thus, the caps 20*a* and 20*e* can be independently supplied negative pressure in order to respectively absorb ink from the nozzles of the corresponding recording heads 17 and 18, that is, in order to conduct respective cleaning operations.

The other structure is substantially the same as the first embodiment shown in FIGS. 1 to 8. In the second embodiment, the same numeral references correspond to the same elements as the first embodiment. The explanation of the same elements is not repeated.

In the embodiment too, when a new color-ink cartridge 2 is set (when a color-ink cartridge is replaced with a new color-ink cartridge 2), the ink-cartridge-replacement judging part 42 judges that the new color-ink cartridge 2 is set, based on a signal from the push switch 44.

Then, the main controlling part 46 obtains the information stored in the semiconductor storing means 32 of the new color-ink cartridge 2, that is, the date when the color-ink cartridge 2 was manufactured (the date of manufacture) and the information about characteristics of the respective inks contained in the color-ink cartridge 2, via the information reader 39.

Then, the calculating part 46*b* provided in the main controlling part 46 calculates a passed time until the present time based on the obtained date of manufacture. In addition, the calculating part 46*b* calculates volumes of the respective color inks to be initially absorbed and respective estimated ink consumptions for the respective color inks, based on the passed time.

The main controlling part 46 sends the estimated ink consumptions to the ink-end controlling part 51, in order to cause the respective estimated-color-ink-consumption storing parts 52*b*–52*d* to store the estimated ink consumptions, respectively.

The main controlling part 46 and the absorbing controlling part 47 controls the absorbing pump 23*e* based on a maximum of the set volumes of the respective inks to be initially absorbed, in order to perform ink-filling operations for the respective inks when the new ink cartridge is set on.

As described above, according to the embodiment, the absorbing pumps 23*a* and 23*e* may be controlled based on the information about the time when the ink cartridge 1 and/or 2 was manufactured. Thus, suitable ink-filling operations can be performed when the new ink cartridge 1 and/or 2 is set on.

In the embodiment, the calculating part 46*b* can calculate the passed time from the date when the ink cartridge 1 or 2 was manufactured until the present time. In addition, the absorbing pumps 23*a* and 23*e* can be controlled in such a manner that the volumes of the respective inks to be initially absorbed are more according to the passed time. Thus, if density of the ink initially introduced to the nozzles is higher than a predetermined level because the passed time from the time of manufacture is longer, the ink having such a higher density can be discharged by the cleaning (absorbing) operation.

Especially, regarding the color-ink cartridge 2, in common for the respective color inks contained in the respective ink chambers 2*a*–2*c*, the absorbing pump 23*e* may be controlled based on the information about the time when the ink cartridge 2 was manufactured. Thus, suitable and simple ink-filling operations for the respective color inks can be performed when the new ink cartridge 2 is set on.

Figure 11:
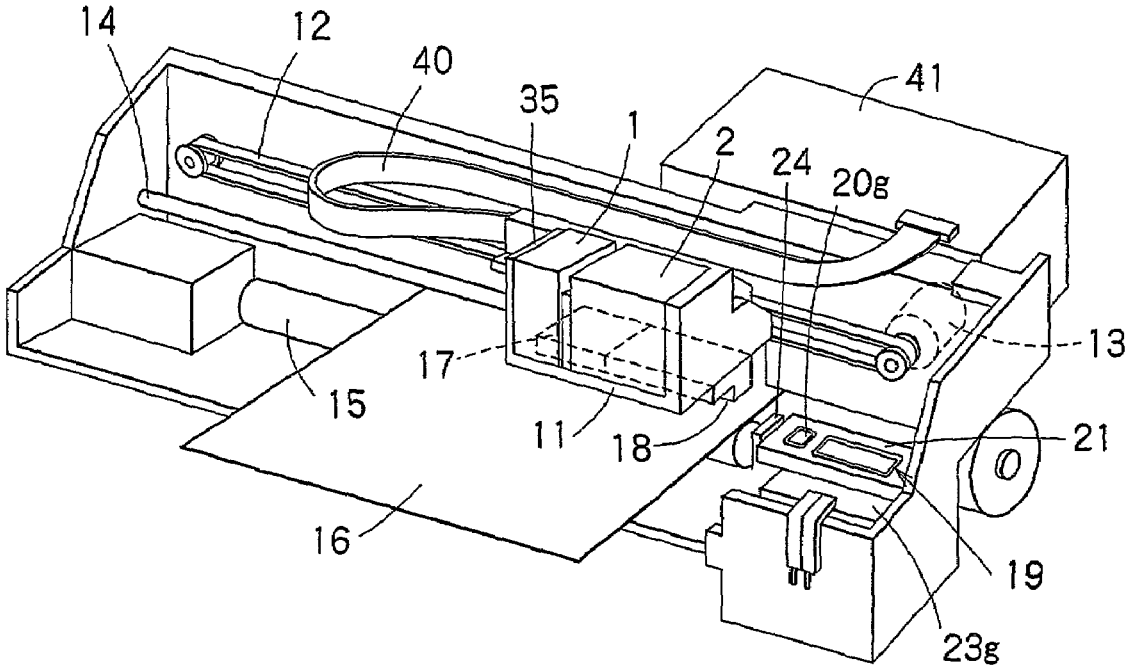
FIG. 11 is a schematic perspective view of a third embodiment of an ink-jet recording apparatus according to the invention.
Figure 12:
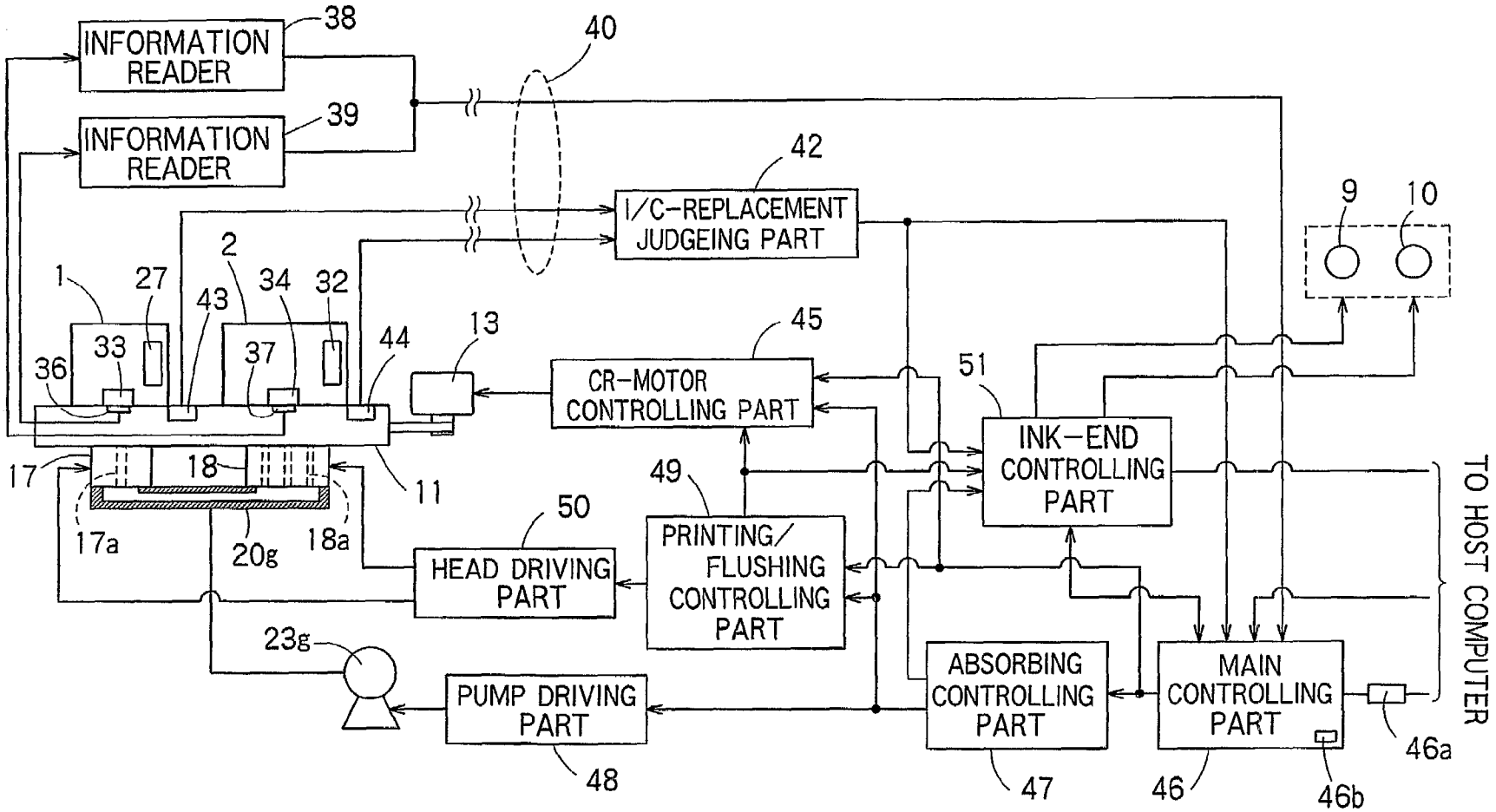
FIG. 12 is a schematic block diagram of a controlling system of the ink-jet recording apparatus shown in FIG. 11.

Next, an ink-jet recording apparatus in a third embodiment according to the invention is explained with reference to FIGS. 11 and 12. FIG. 11 is a schematic view of a printing mechanism in the ink-jet recording apparatus of the third embodiment. FIG. 12 is a schematic block diagram of a controlling system of the ink-jet recording apparatus shown in FIG. 11.

As shown in FIGS. 11 and 12, a capping unit 19 in the ink-jet recording apparatus of the third embodiment has a cap 20*g* for sealing in common the nozzles of the black-ink recording head 17 and the nozzles of the color-ink recording head 18.

In the case, the common cap 20*g* is mounted on the slider 21, and is connected to a single pump unit 23*g* (cleaning unit) that is driven by a motor or the like via a tube (not shown). Thus, the cap 20*g* can be supplied negative pressure in order to absorb ink from all the nozzles of the recording heads 17 and 18, that is, in order to conduct the cleaning operations.

The other structure is substantially the same as the second embodiment shown in FIGS. 9 and 10. In the third embodiment, the same numeral references correspond to the same elements as the second embodiment. The explanation of the same elements is not repeated.

In the embodiment too, when a new black-ink cartridge 1 is set (when a black-ink cartridge is replaced with a new black-ink cartridge 1), the ink-cartridge-replacement judging part 42 judges that the new black-ink cartridge 1 is set, based on a signal from the push switch 43.

Then, the main controlling part 46 obtains the information stored in the semiconductor storing means 27 of the new black-ink cartridge 1, that is, the date when the black-ink cartridge 1 was manufactured (the date of manufacture) and the information about characteristics of the black ink contained in the black-ink cartridge 1, via the information reader 38.

Then, the calculating part 46*b* provided in the main controlling part 46 calculates a passed time until the present time based on the obtained date of manufacture. In addition, the calculating part 46*b* calculates a volume of the black ink to be initially absorbed and an estimated black-ink consumption, based on the passed time.

The main controlling part 46 sends the estimated ink consumption to the ink-end controlling part 51, in order to cause the estimated-black-ink-consumption storing part 52*a* to store the estimated ink consumption.

The main controlling part 46 and the absorbing controlling part 47 controls the absorbing pump 23*g* based on the set volume of the black ink to be initially absorbed, in order to perform an ink-filling operation for the black ink when the new ink cartridge 1 is set on.

Similarly, when a new color-ink cartridge 2 is set (when a color-ink cartridge is replaced with a new color-ink cartridge 2), the ink-cartridge-replacement judging part 42 judges that the new color-ink cartridge 2 is set, based on a signal from the push switch 44.

Then, the main controlling part 46 obtains the information stored in the semiconductor storing means 32 of the new color-ink cartridge 2, that is, the date when the color-ink cartridge 2 was manufactured (the date of manufacture) and the information about characteristics of the respective inks contained in the color-ink cartridge 2, via the information reader 39.

Then, the calculating part 46*b* provided in the main controlling part 46 calculates a passed time until the present time based on the obtained date of manufacture. In addition, the calculating part 46*b* calculates volumes of the respective color inks to be initially absorbed and respective estimated ink consumptions for the respective color inks, based on the passed time.

The main controlling part 46 sends the estimated ink consumptions to the ink-end controlling part 51, in order to cause the respective estimated-color-ink-consumption storing parts 52*b*–52*d* to store the estimated ink consumptions, respectively.

The main controlling part 46 and the absorbing controlling part 47 controls the absorbing pump 23*g* based on a maximum of the volumes of the respective inks to be initially absorbed, in order to perform ink-filling operations for the respective color inks when the new ink cartridge 2 is set on.

When a new black-ink cartridge 1 and a new color-ink cartridge 2 are set at the same time (when a black-ink cartridge and a color-ink cartridge are replaced with a new black-ink cartridge 1 and a new color-ink cartridge 2 at the same time), the absorbing pump 23*g* is controlled based on a maximum of the volume of the black ink to be initially absorbed and the volumes of the respective color inks to be initially absorbed, in order to perform ink-filling operations for all the inks.

As described above, according to the embodiment, the absorbing pump 23*g* may be controlled based on the information about the time when the ink cartridge 1 and/or 2 was manufactured. Thus, suitable ink-filling operations can be performed when the new ink cartridge 1 and/or 2 is set on.

In the embodiment, the calculating part 46*b* can calculate the passed time from the date when the ink cartridge 1 or 2 was manufactured until the present time. In addition, the absorbing pump 23*g* can be controlled in such a manner that the volumes of the respective inks to be initially absorbed are more according to the passed time. Thus, if density of the ink initially introduced to the nozzles is higher than a predetermined level because the passed time from the time of manufacture is longer, the ink having such a higher density can be discharged by the cleaning (absorbing) operation.

Herein, in the above embodiments, the black-ink recording head 17 and the color-ink recording head 18 are formed separately. However, the black-ink recording head 17 and the color-ink recording head 18 may be integrally formed as one body.

In addition, in the above embodiments, the cleaning unit operates as a liquid discharging unit. However, a flushing unit may operate as a liquid discharging unit. Herein, the flushing unit mainly consists of the capping unit 19 and the printing/flushing controlling part 49.

In the case, for example, the printing/flushing controlling part 49 is adapted to receive a control instruction from a main controlling part 46, cause the capping unit 19 to seal the nozzles of the recording heads 17 and 18 via the carriage-motor controlling part 45 and operate the head driving part 50 to suitably jet ink whose volume corresponds to the volume to be initially absorbed from the nozzles.

By such a flushing operation too, suitable ink-filling operations for the respective inks can be performed when the new ink cartridge is set on.

In the above embodiments, for the respective inks, the volume of the ink to be initially absorbed and the estimated ink consumption are determined based on the date when the ink cartridge was manufactured. However, the volume of the ink to be initially absorbed and the estimated ink consumption may be determined based on other information about a sedimentation state of the ink in the ink chamber.

For example, the semiconductor storing means 27 of the black-ink cartridge 1 may store sedimentation-property information as one of the characteristics of the black ink contained in the ink chamber 1*a*. In the case, when the ink-cartridge-set judging part 42 judges that the black-ink cartridge 1 has been set, the main controlling part 46 may obtain the information stored in the semiconductor storing means 27 of the new black-ink cartridge 1, that is, the date when the black-ink cartridge 1 was manufactured and the sedimentation-property information of the black ink contained in the black-ink cartridge 1, via the information reader 38.

For example, the calculating part 46*b* in the main controlling part 46 is adapted to calculate a passed time until the present time based on the obtained date of manufacture. Then, the calculating part 46*b* is adapted to calculate a volume of the black ink to be initially absorbed, based on the passed time. A concrete way of the calculation is explained with reference to FIG. 13.

Figure 13:
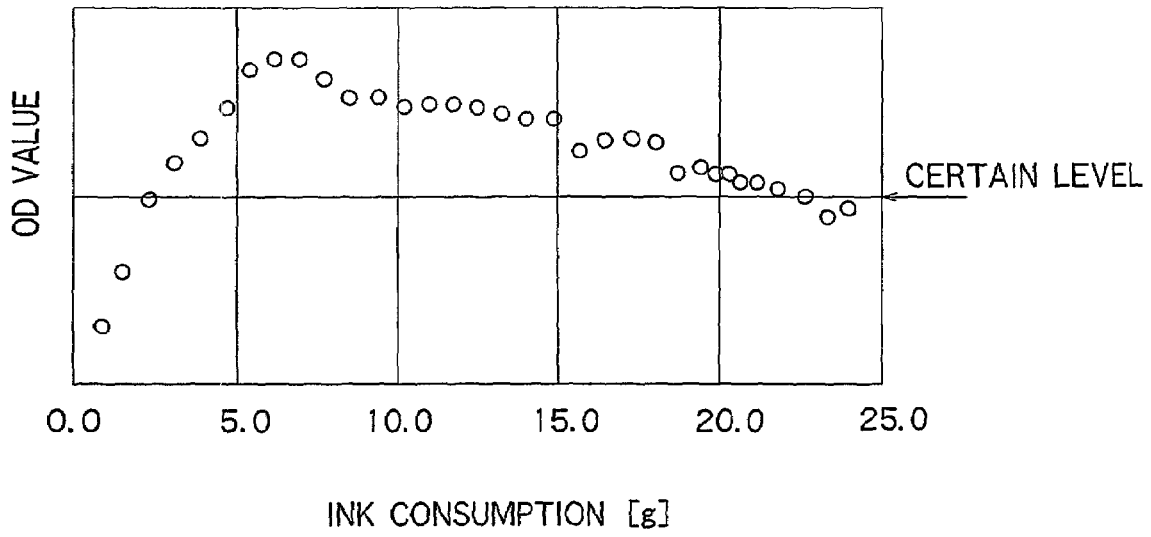
FIG. 13 is a graph of OD values with respect to volumes of ink that is running short.

FIG. 13 is a graph of measured OD values of jetted ink, which has been stored in an ink cartridge that has been set at a predetermined attitude for two years since the ink cartridge was manufactured. The OD value is an index substantially in proportion to density of the ink.

As shown in FIG. 13, in a range of 0 to 5 g of ink consumption, the OD value increases rapidly. In a range of 5 to 20 g of the ink consumption, the OD value decreases gradually and then maintains a certain level stably. Thus, in the case, it is preferable that the volume of the ink to be initially absorbed is 5 g or more.

A gap to the certain level of the OD value as shown in FIG. 13 depends on a continuation time of sedimentation of the ink, which is the passed time from the date of manufacture of the ink cartridge until the present time in the case.

Thus, if a predetermined time or more has passed since the ink cartridge was manufactured, in order to discharge the ink whose density is unsuitable because of the sedimentation of the ink, the volume of the ink to be initially absorbed (discharged) is set more according to the passed time after the manufacture. Herein, in addition to the passed time after the manufacture, the sedimentation-property information of the black ink (tendency of occurring sedimentation) may be considered. In the case, the calculation part 46*b* may function as a sedimentation-state estimating part.

Alternatively, when the ink-cartridge-set judging part 42 judges that the black-ink cartridge 1 has been set, the main controlling part 46 may obtain information about a time when the black-ink cartridge 1 is/was set, by using the clock component 46*a*.

In some types of ink cartridges, a sedimentation state of the ink at a narrow ink-way portion in a ink cartridge may be dissolved by that an user vertically shakes or overturns the ink cartridge before setting the ink cartridge. In the case, sedimentation of the ink that may cause a problem for the ink-jet recording apparatus starts at a time when the ink cartridge is set.

Thus, in the case, preferably, the calculating part 46*b* in the main controlling part 46 is adapted to calculate a passed time from the obtained time when the ink cartridge 1 was set until the present time.

Then, the calculating part 46*b* is adapted to calculate a volume of the black ink to be initially absorbed, based on the passed time. The calculation may be conducted based on previously measured data as shown in FIG. 13. In the case too, in addition to the passed time after the set time, the sedimentation-property information of the black ink may be considered.

Alternatively, the main controlling part 46 may obtain information about a time when the black-ink was jetted last time, by using the clock component 46*a*.

In some ways of using the ink-jet recording apparatus, use of the black ink may be suspended for a long time from the time when the black-ink was jetted last time. In the case, sedimentation of the ink that may cause a problem for the ink-jet recording apparatus starts from the time when the ink was jetted last time.

Thus, in the case, preferably, the calculating part 46*b* in the main controlling part 46 is adapted to calculate a passed time from the obtained time when the black-ink 1 was jetted last time until the present time.

Then, the calculating part 46*b* is adapted to calculate a volume of the black ink to be initially absorbed, based on the passed time. The calculation may be also conducted based on previously measured data as shown in FIG. 13. In the case too, in addition to the passed time after the last jetting time, the sedimentation-property information of the black ink may be considered.

Alternatively, if the ink cartridge may be stirred by a stirring mechanism or the like, information about a time when the ink cartridge was stirred last time may be stored in the semiconductor storing means 27 of the ink cartridge. In the case, the information may be obtained via the information reader 38.

Alternatively, if a stirring mechanism for stirring the ink cartridge is provided in the ink-jet recording apparatus, the main controlling part 46 may obtain information about a time when the ink cartridge was stirred last time, by using the clock component 46*a*.

In the above cases, it is preferable to dissolve a sedimentation state of the ink always before jetting ink, by using the stirring mechanism or the like. However, the stirring operation by the stirring mechanism or the like and the cleaning (absorbing) operation for the ink whose density is unsuitable may be selectively performed taking into account cost or the like. In the case, sedimentation of the ink that may cause a problem for the ink-jet recording apparatus starts from the time when the ink was stirred last time.

Thus, in the case, preferably, the calculating part 46*b* in the main controlling part 46 is adapted to calculate a passed time from the obtained time when the ink cartridge was stirred last time until the present time.

Then, the calculating part 46*b* is adapted to calculate a volume of the black ink to be initially absorbed, based on the passed time. The calculation may be also conducted based on previously measured data as shown in FIG. 13. In the case too, in addition to the passed time after the last stirring time, the sedimentation-property information of the black ink may be considered.

The main controlling part 46 and the absorbing controlling part 47 are adapted to control the absorbing pump 23*a* based on the volume of the ink to be initially absorbed, in order to perform an ink-filling operation when the new ink cartridge is set on.

Similarly, for example, when the ink-cartridge-set judging part 42 judges that the color-ink cartridge 2 has been set, the main controlling part 46 may obtain the information stored in the semiconductor storing means 32 of the new color-ink cartridge 2, that is, the date when the color-ink cartridge 2 was manufactured and sedimentation-property information of the respective color inks contained in the color-ink cartridge 2, via the information reader 39.

Then, the calculating part 46*b* in the main controlling part 46 is adapted to calculate a passed time from the obtained date of manufacture until the present time.

Then, the calculating part 46*b* is adapted to calculate volumes of the respective color inks to be initially absorbed, based on the passed time. A detailed way of the calculation for the respective color inks is substantially the same as for the black ink. Herein, preferably, in addition to the passed time after the manufacture, the sedimentation-property information of the respective color inks (tendency of occurring sedimentation) may be considered.

Alternatively, when the ink-cartridge-set judging part 42 judges that the color-ink cartridge 2 has been set, the main controlling part 46 may obtain information about a time when the color-ink cartridge 2 is/was set, by using the clock component 46*a*.

In the case, the calculating part 46*b* in the main controlling part 46 is adapted to calculate a passed time from the obtained time when the ink cartridge 2 was set until the present time.

Then, the calculating part 46*b* is adapted to calculate volumes of the respective color inks to be initially absorbed, based on the passed time. The calculation may be also conducted based on previously measured data as shown in FIG. 13. In the case too, in addition to the passed time after the set time, the sedimentation-property information of the respective color inks may be considered.

Alternatively, the main controlling part 46 may obtain information about times when the respective color inks were jetted last time, by using the clock component 46*a*.

In the case, the calculating part 46*b* in the main controlling part 46 is adapted to calculate passed times from the obtained times when the respective color inks were jetted last time until the present time.

Then, the calculating part 46*b* is adapted to calculate volumes of the respective color inks to be initially absorbed, based on the passed times. The calculation may be also conducted based on previously measured data as shown in FIG. 13. In the case too, in addition to the passed times after the last jetting times, the sedimentation-property information of the respective color inks may be considered.

Alternatively, if the color-ink cartridge may be stirred by a stirring mechanism or the like, information about a time when the color-ink cartridge was stirred last time may be stored in the semiconductor storing means 32 of the color-ink cartridge. In the case, the information may be obtained via the information reader 39.

Alternatively, if a stirring mechanism for stirring the color-ink cartridge is provided in the ink-jet recording apparatus, the main controlling part 46 may obtain information about a time when the color-ink cartridge was stirred last time, by using the clock component 46*a*.

In the above cases, the calculating part 46*b* in the main controlling part 46 is adapted to calculate a passed time from the obtained time when the ink cartridge was stirred last time until the present time.

Then, the calculating part 46*b* is adapted to calculate volumes of the respective color inks to be initially absorbed, based on the passed time. The calculation may be also conducted based on previously measured data as shown in FIG. 13. In the case too, in addition to the passed time after the last stirring time, the sedimentation-property information of the respective color inks may be considered.

The main controlling part 46 and the absorbing controlling part 47 are adapted to control the absorbing pumps 23*b*–23*d* based on the set volumes of the respective color inks to be initially absorbed, in order to perform ink-filling operations for the respective inks when the new ink cartridge is set on.

Next, regarding the above cases, an operation is explained.

When a new black-ink cartridge 1 is set (when a black-ink cartridge is replaced with a new black-ink cartridge 1), the ink-cartridge-set judging part 42 judges that the new black-ink cartridge 1 is set, based on a signal from the push switch 43.

Then, the main controlling part 46 obtains the information stored in the semiconductor storing means 27 of the new black-ink cartridge 1, that is, the date when the black-ink cartridge 1 was manufactured (the date of manufacture), the sedimentation-property information of the black ink contained in the black-ink cartridge 1, the information about the time when the ink cartridge 1 was stirred last time, and so on, via the information reader 38.

Then, the calculating part 46*b* provided in the main controlling part 46 calculates a passed time from the obtained date of manufacture until the present time. Alternatively, the calculating part 46*b* calculates a passed time from a time when the black-ink cartridge was set until the present time. Alternatively, the calculating part 46*b* calculates a passed time from a time when the black ink was jetted last time until the present time. Alternatively, the calculating part 46*b* calculates a passed time from a time when the black-ink cartridge was stirred last time until the present time.

In addition, the calculating part 46*b* estimates a sedimentation state of the black ink and calculates a volume of the black ink to be initially absorbed, based on the passed time and the sedimentation-property information of the black ink.

If the passed time is longer than a predetermined time, density of the black ink may be uneven because of the sedimentation of the ink. Thus, in order to discharge the ink whose density is unsuitable to perform the recording operation at a high quality, the volume of the ink to be initially absorbed (discharged) is set more according to the passed time.

The main controlling part 46 and the absorbing controlling part 47 controls the absorbing pump 23*a* based on the set volume of the black ink to be initially absorbed, in order to perform an ink-filling operation for the black ink when the new ink cartridge is set on.

Similarly, when a new color-ink cartridge 2 is set (when a color-ink cartridge is replaced with a new color-ink cartridge 2), the ink-cartridge-set judging part 42 judges that the new color-ink cartridge 2 is set, based on a signal from the push switch 44.

Then, the main controlling part 46 obtains the information stored in the semiconductor storing means 32 of the new color-ink cartridge 2, that is, the date when the color-ink cartridge 2 was manufactured (the date of manufacture), the sedimentation-property information of the respective color inks contained in the color-ink cartridge 2, the information about the time when the ink cartridge 2 was stirred last time, and so on, via the information reader 39.

Then, the calculating part 46*b* provided in the main controlling part 46 calculates a passed time from the obtained date of manufacture until the present time. Alternatively, the calculating part 46*b* calculates a passed time from a time when the color-ink cartridge was set until the present time. Alternatively, the calculating part 46*b* calculates passed times from times when the respective color inks were jetted last time until the present time. Alternatively, the calculating part 46*b* calculates a passed time from a time when the color-ink cartridge was stirred last time until the present time.

In addition, the calculating part 46*b* estimates sedimentation states of the respective color inks and calculates volumes of the respective inks to be initially absorbed, based on the passed time or the passed times and the sedimentation-property information of the respective inks.

If the passed time is longer than a predetermined time, density of color ink may be uneven because of the sedimentation of the color ink. Thus, in order to discharge the color ink whose density is unsuitable to perform the recording operation at a high quality, the volume of the color ink to be initially absorbed (discharged) is set more according to the passed time.

The main controlling part 46 and the absorbing controlling part 47 controls the absorbing pumps 23*b*–23*d* based on the set volumes of the respective color inks to be initially absorbed, in order to perform ink-filling operations for the respective color inks when the new ink cartridge is set on.

In the above case, the absorbing pumps 23*a*–23*d* may be controlled based on the suitable information about respective sedimentation states of the respective inks in the ink cartridges 1 and 2. In the case too, suitable ink-filling operations can be performed when the new ink cartridge 1 and/or 2 is set on.

The above description is given for the ink-jetting recording apparatus as a liquid jetting apparatus according to the invention. However, this invention is intended to apply to general liquid jetting apparatuses widely. A liquid may be glue, nail polish or the like, instead of the ink.

As described above, according to a feature of the invention, since the liquid discharging unit is controlled based on the information about the time when the liquid container was manufactured, a suitable liquid discharging operation can be conducted, for example when the liquid container is newly set.

In addition, according to a feature of the invention, since the liquid end is determined (judged) based on the information about the time when the liquid container was manufactured and the liquid consumption, the liquid end can suitably correspond to density of the liquid at a predetermined level.

In addition, according to a feature of the invention, since the respective liquid discharging units are controlled based on the information about the time when the liquid container was manufactured, respective suitable liquid discharging operations for the respective kinds of liquid can be conducted, for example when the liquid container is newly set.

In addition, according to a feature of the invention, since the respective liquid ends are determined (judged) based on the information about the time when the liquid container was manufactured and the respective liquid consumptions, the respective liquid ends can suitably correspond to densities of the respective kinds of liquid at respective predetermined levels.

Alternatively, according to a feature of the invention, since the liquid discharging unit is controlled based on the information about the sedimentation state of the liquid in the liquid chamber, a suitable liquid discharging operation can be conducted, for example when the liquid container is newly set.

Alternatively, according to a feature of the invention, since the liquid end is determined (judged) based on the information about the sedimentation state of the liquid in the liquid chamber and the liquid consumption, the liquid end can suitably correspond to density of the liquid at a predetermined level.

Alternatively, according to a feature of the invention, since the respective liquid discharging unit are controlled based on the information about the respective sedimentation states of the plurality of kinds of liquid in the plurality of liquid chambers, respective suitable liquid discharging operations for the respective kinds of liquid can be conducted, for example when the liquid container is newly set.

Alternatively, according to a feature of the invention, since the respective liquid ends are determined based on the information about the respective sedimentation states of the respective kinds of liquid in the plurality of liquid chambers and the respective liquid consumptions, the respective liquid ends can suitably correspond to densities of the respective kinds of liquid at respective predetermined levels.

What is claimed is:

1. A liquid jetting apparatus comprising;

a container-setting portion at which a liquid container is set, the liquid container having a liquid chamber that contains liquid, a head member having a nozzle, a liquid way that can communicate with the liquid chamber of the liquid container set at the container-setting portion and the nozzle, a liquid discharging unit that can cause the liquid to be discharged from the nozzle, and a liquid discharging controller that can control the liquid discharging unit based on information about sedimentation-property of the liquid in the liquid chamber and information about sedimentation-state of the liquid in the liquid chamber, a clock component that knows a present time, and a sedimentation-state acquiring unit that can acquire the information about sedimentation-state of the liquid in the liquid chamber, wherein the information about sedimentation-state of the liquid in the liquid chamber is information about a point of time that is a standard for judgement of the sedimentation-state, the liquid discharging controller has:

a calculating part that can calculate a passed time until the present time based on the information about a point of time that is a standard for judgement of the sedimentation-state, and a main controlling part that can control the liquid discharging unit based on the passed time, wherein:

a liquid-consumption totaling unit that can total a liquid consumption from the nozzle, and a liquid-end determining unit that can determine a liquid end based on the information about a point of time that is a standard for judgment of the sedimentation-state and the liquid consumption.

2. A liquid jetting apparatus according to claim 1, wherein:

the liquid-end determining unit has:

a calculating part that can calculate a passed time until the present time based on the information about a point of time that is a standard for judgment of the sedimentation-state, and a main determining part that can determine the liquid end based on the passed time.

3. A liquid jetting apparatus according to claim 2, wherein:

the main determining part is adapted to determine the liquid end correspondingly to a smaller liquid consumption when the passed time is longer.

4. A liquid jetting apparatus comprising;

a container-setting portion at which a liquid container is set, the liquid container having a liquid chamber that contains liquid;

a head member having a nozzle;

a liquid way that can communicate with the liquid chamber of the liquid container set at the container-setting portion and the nozzle;

a liquid discharging unit that can cause the liquid to be discharged from the nozzle;

a liquid discharging controller that can control the liquid discharging unit based on information about sedimentation-state of the liquid in the liquid chamber;

a clock component that knows a present time;

a sedimentation-state acquiring unit that can acquire the information about sedimentation-state of the liquid in the liquid chamber;

a liquid-consumption totaling unit that can total a liquid consumption from the nozzle, and a liquid-end determining unit that can determine a liquid end based on the information about a point of time that is a standard for judgement of the sedimentation-state and the liquid consumption and the liquid discharging controller further having:

a calculating part that can calculate a passed time until the present time based on the information about a point of time that is a standard for judgement of the sedimentation-state, and a main controlling part that can control the liquid discharging unit based on the passed time;

wherein the information about sedimentation-state of the liquid in the liquid chamber is information about a point of time that is a standard for judgement of the sedimentation-state.

5. A liquid jetting apparatus according to claim 4, wherein:

the liquid-end determining unit further includes:

a calculating part that can calculate a passed time until the present time based on the information about a point of time that is a standard for judgement of the sedimentation-state, and a main determining part that can determine the liquid end based on the passed time.

6. A liquid jetting apparatus according to claim 5, wherein:

the main determining part is adapted to determine the liquid end correspondingly to a smaller liquid consumption when the passed time is longer.

7. A liquid jetting apparatus comprising:

a container-setting portion at which a liquid container is set, the liquid container having a liquid chamber that contains liquid and a storage that stores information about sedimentation-state of the liquid in the liquid chamber, the liquid including a sinkable constituent, a head member having a nozzle, a liquid way that can communicate with the liquid chamber of the liquid container set at the container-setting portion and the nozzle, and a sedimentation-state acquiring unit that can acquire the information about sedimentation-state of the liquid in the liquid chamber from the storage unit, and wherein the information about sedimentation-state of the liquid in the liquid chamber is information about a point of time that is a standard for judgment of the sedimentation-state, and wherein the point of time that is a standard for judgment of the sedimentation-state is a point of time when the liquid container was stirred previous time, a clock component that knows a present time, and a calculating part that can calculate a passed time until the present time based on the information about a point of time that is a standard for judgment of the sedimentation-state, a liquid discharging unit that can cause the liquid to be discharged from the nozzle, and a main controlling part that can control the liquid discharging unit based on the passed time, wherein:

the main controlling part is adapted to control the liquid discharging unit when the liquid container is replaced with a new liquid container in such a manner that a volume of the liquid to be initially discharged is larger when the passed time calculated based on the information about sedimentation-state of the liquid in the liquid chamber of the new liquid container set at the container-setting portion is longer.

8. A liquid jetting apparatus comprising:

a container-setting portion at which a liquid container is set, the liquid container having a liquid chamber that contains liquid and a storage that stores information about sedimentation-state of the liquid in the liquid chamber, the liquid including a sinkable constituent, a head member having a nozzle, a liquid way that can communicate with the liquid chamber of the liquid container set at the container-setting portion and the nozzle, and a sedimentation-state acquiring unit that can acquire the information about sedimentation-state of the liquid in the liquid chamber from the storage unit, and wherein the information about sedimentation-state of the liquid in the liquid chamber is information about a point of time that is a standard for judgment of the sedimentation-state, and wherein the point of time that is a standard for judgment of the sedimentation-state is a point of time when the liquid container was stirred previous time, a liquid discharging unit that can cause the liquid to be discharged from the nozzle, and a main controlling part that can estimate the sedimentation-state based on the information about a point of time that is a standard for judgment of the sedimentation-state and information about easiness of sedimentation of the sinkable constituent in the liquid, and that can control the liquid discharging unit based on the estimated sedimentation-state.

* * * * *